US010100778B2

(12) United States Patent
Nuel et al.

(10) Patent No.: US 10,100,778 B2
(45) Date of Patent: Oct. 16, 2018

(54) STIRLING CYCLE AND LINEAR-TO-ROTARY MECHANISM SYSTEMS, DEVICES, AND METHODS

(71) Applicant: Cool Energy, Inc., Boulder, CO (US)

(72) Inventors: Brian Nuel, Boulder, CO (US); Lee S. Smith, Boulder, CO (US); Samuel P. Weaver, Boulder, CO (US); William Gross, Pasadena, CA (US); Stefan Berkower, Boulder, CO (US)

(73) Assignee: Cool Energy, Inc., Boulder, CO (US)

( * ) Notice: Subject to any disclaimer, the term of this patent is extended or adjusted under 35 U.S.C. 154(b) by 52 days.

(21) Appl. No.: 15/151,325

(22) Filed: May 10, 2016

(65) Prior Publication Data

US 2017/0022932 A1 Jan. 26, 2017

Related U.S. Application Data

(60) Provisional application No. 62/159,545, filed on May 11, 2015.

(51) Int. Cl.
*F02G 1/04* (2006.01)
*F02G 1/044* (2006.01)
(Continued)

(52) U.S. Cl.
CPC ..... *F02G 1/044* (2013.01); *F01B 3/02* (2013.01); *F01B 3/04* (2013.01); *F02G 1/00* (2013.01);
(Continued)

(58) Field of Classification Search
CPC .. F02G 1/044; F02G 1/0445; F01B 3/04–3/08
(Continued)

(56) References Cited

U.S. PATENT DOCUMENTS 2,480,525 A 8/1949 Van Weenen
2,564,363 A 8/1951 Horowitz
(Continued)

FOREIGN PATENT DOCUMENTS

DE 4320356 A1 * 12/1994 ..... F02G 1/044

OTHER PUBLICATIONS

International Search Report and Written Opinion for PCT/US2016/031716, dated Aug. 11, 2016, ISA/US.
(Continued)

*Primary Examiner* — Laert Dounis
(74) *Attorney, Agent, or Firm* — Wilson Patent Law, LLC

(57) ABSTRACT

Methods, systems, and devices are provided that may include Stirling cycle configurations and/or linear-to-rotary mechanisms in accordance with various embodiments. Some embodiments include a Stirling cycle device that may include a first hot piston contained within a first hot cylinder and a first cold piston contained within a first cold cylinder. A first single actuator may be configured to couple the first hot piston with the first cold piston such that the first hot piston and the first cold piston are on different thermodynamic circuits. The different thermodynamic circuits may include adjacent thermodynamic circuits. The Stirling cycle configuration may be configured as a single-acting alpha Stirling cycle configuration. Some embodiments include a linear-to-rotary mechanism device. The device may include multiple linkages. The device may include a cam plate coupled with the multiple linkages utilizing a cam and multiple cam followers. The linkages may include Watt linkages.

22 Claims, 17 Drawing Sheets

(51) Int. Cl.

| | |
|---|---|
| ***F02G 1/00*** | (2006.01) |
| ***F02G 1/043*** | (2006.01) |
| ***F01B 3/02*** | (2006.01) |
| ***F01B 3/04*** | (2006.01) |

(52) U.S. Cl.
CPC ..... *F02G 1/04* (2013.01); *F02G 1/043* (2013.01); *F02G 2244/00* (2013.01); *F02G 2270/42* (2013.01); *F02G 2270/55* (2013.01)

(58) Field of Classification Search
USPC ..... 60/625
See application file for complete search history.

(56) References Cited

U.S. PATENT DOCUMENTS

| | | | | |
|---|---|---|---|---|
| 3,895,614 | A | 7/1975 | Bailey | |
| 4,199,945 | A * | 4/1980 | Finkelstein | F02G 1/0435 60/520 |
| 4,413,474 | A | 11/1983 | Moscrip | |
| 4,428,197 | A * | 1/1984 | Liljequist | F01B 9/02 60/517 |
| 4,522,032 | A * | 6/1985 | Nakamura | F25B 9/14 62/513 |
| 5,442,913 | A | 8/1995 | Cho | |
| 7,219,647 | B1 | 5/2007 | Brickley | |
| 7,891,184 | B2 | 2/2011 | Gimsa | |
| 8,608,234 | B2 | 12/2013 | Haeusler | |
| 9,790,890 | B2 * | 10/2017 | Osborne | F02G 1/00 |
| 2004/0231620 | A1 * | 11/2004 | Cannata | F01B 3/0002 123/56.1 |
| 2006/0207249 | A1 | 9/2006 | Yaguchi | |
| 2006/0213292 | A1 | 9/2006 | Thomas | |
| 2010/0132354 | A1 * | 6/2010 | Fanner | F01B 3/0002 60/525 |

OTHER PUBLICATIONS

First Office Action, Chinese Appl. No. 201680002557.6, SIPO, dated Aug. 3, 2017.

* cited by examiner

STIRLING CYCLE AND LINEAR-TO-ROTARY MECHANISM SYSTEMS, DEVICES, AND METHODS

CROSS-REFERENCES TO RELATED APPLICATIONS

This application is a non-provisional patent application claiming priority benefit of U.S. provisional patent application Ser. No. 62/159,545, filed on May 11, 2015 and entitled "STIRLING ENGINE AND LINEAR-TO-ROTARY MECHANISM METHODS, SYSTEMS, AND DEVICES," the entire disclosure of which is herein incorporated by reference for all purposes.

BACKGROUND

This application relates generally to Stirling cycle and/or linear-to-rotary methods, systems, and devices.

Stirling cycle devices generally involve the use of pistons reciprocating in cylinders for changing a working volume of gas trapped therein and for moving the gas through heat exchangers that may add or remove heat. While different Stirling cycle designs may be known, there may still be the need for new tools and techniques with respect to Stirling cycle design. Furthermore, there may be a need for tools and techniques for converting linear motion, such as from the one or more pistons of a Stirling cycle device, into rotary motion.

BRIEF SUMMARY

Methods, systems, and/or devices are provided that may include Stirling cycle configurations and/or linear-to-rotary mechanisms in accordance with various embodiments.

For example, some embodiments include a Stirling cycle system. The system may include: a first hot piston contained within a first hot cylinder; a first cold piston contained within a first cold cylinder; and/or a first single actuator configured to couple the first hot piston with the first cold piston such that the first hot piston and the first cold piston are on different thermodynamic circuits.

The different thermodynamic circuits may include adjacent thermodynamic circuits. In some embodiments, the first hot piston and the first cold piston are spatially in line with each other. In some embodiments, the first hot piston and the first cold piston are spatially offset from each other.

In some embodiments, the system may include: a second hot piston contained within a second hot cylinder; a second cold piston contained within a second cold cylinder; and/or a second single actuator configured to couple the second hot piston with the second cold piston such that the second hot piston and the second cold piston are on different thermodynamic circuits. The different thermodynamic circuits may include adjacent thermodynamic circuits.

In some embodiments, the first cold piston and the second hot piston are on a same thermodynamic circuit. In some embodiments, first cold piston and the second hot piston are spatially in line with each other. In some embodiments, the first cold piston and the second hot piston are spatially offset from each other. In some embodiments, the first cold piston and second hot piston are part of a single-acting alpha Stirling cycle configuration.

Some embodiments include a linear-to-rotary mechanism coupled with at least the first single actuator or the second single actuator. In some embodiments, the linear-to-rotary mechanism includes: multiple linkages; and/or a cam plate coupled with the multiple linkages utilizing a cam and multiple cam followers. In some embodiments, the cam and the multiple cam followers are configured as conical surfaces. In some embodiments, the multiple linkages are Watt linkages. In some embodiments, each respective conical surface has a respective apex and the cam and the multiple cam followers are configured such that each of the multiple apexes is coincident with each other. In some embodiments, an axis of the cam and a respective axis of each of the multiple cam followers are inclined with respect to an axis of rotation of a main shaft. In some embodiments, the multiple apexes of the conical surfaces lie on the axis of rotation of the main shaft. In some embodiments, at least two of the multiple linkages are mechanically coupled with each other.

In some embodiments, the linear-to-rotary mechanism includes a barrel cam and carriage mechanism. In some embodiments, the multiple linkages are configured to couple the first single actuator and the second single actuator with each other at least to drive the first single actuator and the second single actuator or to be driven by the first single actuator and the second single actuator while maintaining a phase relationship between the first single actuator and the second single actuator.

Some embodiments include methods, systems, and/or devices as described in specification and/or shown in the figures.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
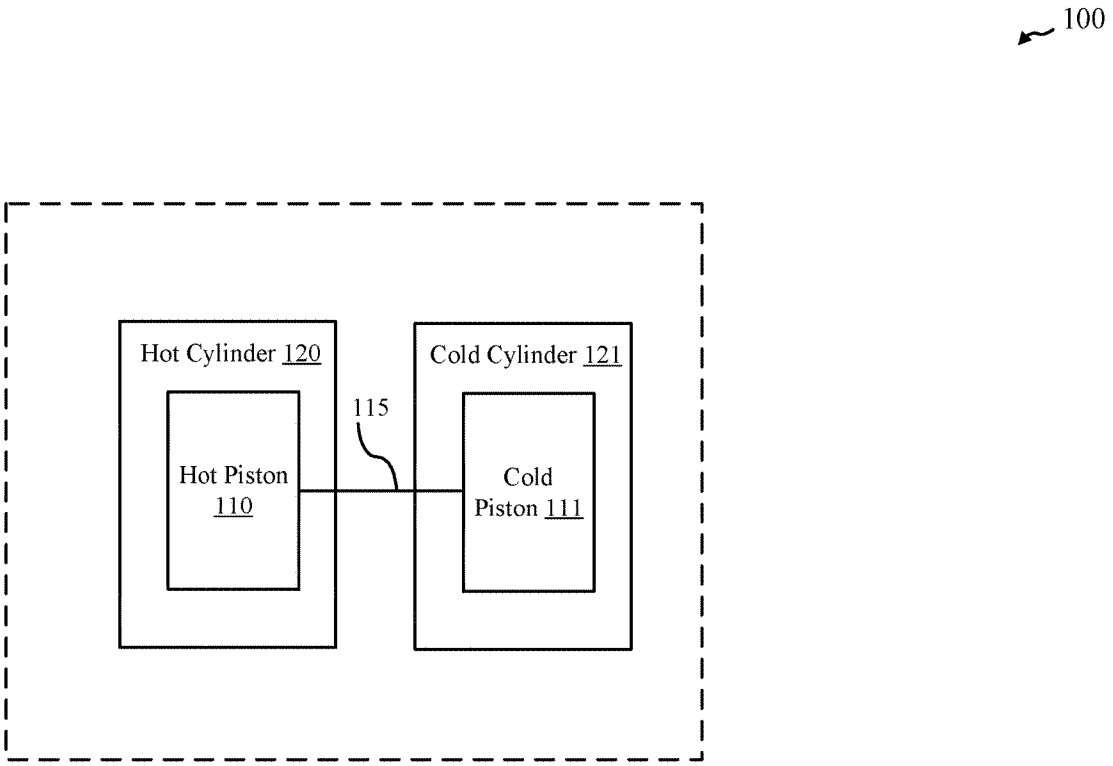
FIG. 1A shows a Stirling cycle device in accordance with various embodiments.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments, it being understood that various changes may be made in the function and arrangement of elements without departing from the spirit and scope of the invention as set forth in the appended claims. Several embodiments are described herein, and while various features are ascribed to different embodiments, it should be appreciated that the features described with respect to one embodiment may be incorporated within other embodiments as well. By the same token, however, no single feature or features of any described embodiment should be considered essential to every embodiment, as other embodiments may omit such features.

Specific details are given in the following description to provide a thorough understanding of the embodiments. However, it will be understood by one of ordinary skill in the art that the embodiments may be practiced without these specific details. For example, systems, networks, processes, and other elements in embodiments may be shown as components in block diagram form in order not to obscure the embodiments in unnecessary detail. In other instances, well-known processes, structures, and techniques may be shown without unnecessary detail in order to avoid obscuring the embodiments.

Also, it is noted that individual embodiments may be described as a process which may be depicted as a flowchart, a flow diagram, a structure diagram, or a block diagram. Although a flowchart may describe the operations as a sequential process, many of the operations can be performed in parallel or concurrently. In addition, the order of the operations may be rearranged. A process may be terminated when its operations are completed, but could also comprise additional operations not discussed or included in a figure. Furthermore, not all operations in any particularly described process may occur in all embodiments. A process may correspond to a method, a function, a procedure, a subroutine, a subprogram, etc.

Methods, systems, and/or devices are provided that may include Stirling cycle configurations and/or linear-to-rotary mechanisms in accordance with various embodiments. Stirling cycle devices and/or systems may generally involve the use of pistons reciprocating in cylinders for effecting the motion, compression, and expansion of a gas, hereinafter referred to as a working fluid, so as to move the working fluid through heat exchangers that may add heat to or remove heat from the working fluid, and thereby change the pressure of the working fluid. Stirling cycle devices and/or systems generally include a volume, hereinafter referred to as a working volume, which may be bound by the aforesaid pistons, cylinders, heat exchangers, diffusers that may allow streamlined flow between the cylinders and heat exchangers, and/or any ducting connecting the cylinders, heat exchangers, and/or diffusers, which may trap the working fluid therein. The timing of the piston motion may be such that if the working volume expands during a period of high pressure and contracts during a period of low pressure, a net amount of work per cycle may be produced, making the Stirling cycle device and/or system an engine. Alternatively, the timing of the piston motion may be such that if the working volume contracts during a period of high pressure and expands during a period of low pressure, a net amount of work per cycle may be absorbed, making the Stirling cycle device and/or system a refrigerator or a heat pump, for example. The combination of pistons, cylinders, heat exchangers, diffusers, and/or any ducting connecting the cylinders, heat exchangers, and/or diffusers that may include a single working volume may hereinafter be referred to as a thermodynamic circuit. A Stirling cycle device and/or system may be composed of one or more thermodynamic circuits. Two or more thermodynamic circuits may be physically arranged to be adjacent.

It will be understood by one of ordinary skill in the art that a Stirling cycle device and/or system may be operated as a refrigerator or a heat pump, for example, and that every reference herein to an engine may be taken to refer to a refrigerator or a heat pump, and every reference herein to a refrigerator or a heat pump may be taken to refer to an engine. In general, the term Stirling cycle device and/or system may thus generally refer to engines, refrigerators, and/or heat pumps. Some embodiments include a Stirling cycle device and/or system that may include a hot piston contained within a hot cylinder and a cold piston contained within a cold cylinder. It will be understood by one of ordinary skill in the art that the function of the hot piston contained within the hot cylinder may be interchanged with the function of the cold piston contained within the cold cylinder, that is, what had been designated as the hot piston contained within the hot cylinder may be operated as the cold piston contained within the cold cylinder, and what had been designated as the cold piston contained within the cold cylinder may be operated as the hot piston contained within the hot cylinder.

For example, some embodiments include a Stirling cycle device and/or system that may include a first hot piston contained within a first hot cylinder and a first cold piston contained within a first cold cylinder. The first cold piston may be mechanically coupled with the first hot piston by mechanically coupling each with a first single actuator such that the first hot piston and the first cold piston are configured to be on different thermodynamic circuits. The different thermodynamic circuits may include adjacent thermodynamic circuits.

In some embodiments, the first hot piston and the first cold piston are configured to be spatially in line with each other. In some embodiments, the first hot piston and the first cold piston are configured to be spatially offset from each other.

In some embodiments, at least a second hot piston contained within a second hot cylinder and a second cold piston contained within a second cold cylinder are provided. The second hot piston and the second cold piston may be mechanically coupled with each other by mechanically coupling each with a second single actuator such that the second hot piston and the second cold piston may be configured to be on different thermodynamic circuits, which also may be adjacent thermodynamic circuits. The first cold piston and the second hot piston may be configured to be on the same thermodynamic circuit in some cases. The first cold piston and the second hot piston may be configured to be spatially in line with each other in some cases. The first cold piston and the second hot piston may be configured to be spatially offset from each other in some cases. The first cold piston and second hot piston may be configured as part of a single-acting alpha Stirling cycle device configuration.

Some embodiments include a Stirling cycle system. The system may include multiple paired pistons contained within multiple cylinders. Each of the paired pistons may include a hot piston mechanically coupled with a cold piston by mechanically coupling each with a single actuator such that the hot piston and the cold piston are configured to be on different thermodynamic circuits. The different thermodynamic circuits may also be adjacent thermodynamic circuits.

Some embodiments include a linear-to-rotary mechanism coupled with the multiple single actuators. The linear-to-rotary mechanism may be configured to couple the multiple single actuators with each other at least to drive the single actuators or to be driven by the actuators while maintaining a phase relationship between the single actuators. In some embodiments of the system, the multiple paired pistons are configured as a single-acting alpha Stirling configuration. In some embodiments the rotating part of the linear-to-rotary mechanism may include a main shaft.

In some embodiments, the linear-to-rotary mechanism may include a barrel cam and carriage mechanism. In other embodiments, the linear-to-rotary mechanism may include multiple linkages for synthesizing linear or nearly linear motion, which mechanism may include a cam plate coupled with the multiple linkages utilizing a cam and multiple cam followers. In some embodiments, the linkages may include Watt linkages.

In some embodiments, the cam and the multiple cam followers are configured as circular conical surfaces, hereinafter referred to as conical surfaces. The cam and the multiple cam followers may be configured such that the apexes of all their respective conical surfaces may be coincident. An axis of the cam and a respective axis of each of the multiple cam followers may be inclined with respect to an axis of rotation of a main shaft. The multiple apexes of the conical surfaces may lie on the axis of rotation of the main shaft.

Turning now to FIG. 1A, a Stirling cycle device 100 in accordance with various embodiments is provided. The device may include a hot piston 110, which may be referred to as a first hot piston, contained within a hot cylinder 120, which may be referred to as a first hot cylinder. Device 100 may include cold piston 111, which may be referred to as a first cold piston, contained within a cold cylinder 121, which may be referred to as a first cold cylinder. A single actuator 115 may mechanically couple the cold piston 111 with the hot piston 110 such that the hot piston 110 and the cold piston 111 may be on different thermodynamic circuits. The different thermodynamic circuits may include adjacent thermodynamic circuits. Through mechanically coupling the hot piston 110 with the cold piston 111 using the single actuator 115, the motion of the hot piston 110 and the cold piston 111 may be in unison. The motion may be such that the hot piston 110 and the cold piston 111 may keep a fixed physical relationship through the use of the single actuator. In some cases, Stirling cycle device 100 may be referred to as a Stirling cycle system.

Device 100 may be configured utilizing a variety of different thermo-mechanical configurations. For example, the hot piston 110, along with the hot cylinder 120, and cold piston 111, along with the cold cylinder 121, may be spatially in line with each other. An example of such a configuration may be shown in FIG. 1B, described in more detail below. In this example of FIG. 1B, cold piston 111-*a* and cold cylinder 121-*a* may be spatially offset from hot piston 110-*b* and hot cylinder 120-*b* that are on the same thermodynamic circuit. A gas path 130 connecting cold piston 111-*a* and cold cylinder 121-*a* with hot piston 110-*b* and hot cylinder 120-*b* on the same thermodynamic circuit may therefore be bent. This configuration may be hereinafter referred to as a thermal offset configuration. In some embodiments, the bent gas path 130 may be at a 90 degree angle, though other angles less than or greater than 90 degrees may also be utilized. In some cases, the gas path 130 may involve one or more of the pistons 110 not being centered on respective heat exchangers. In some cases, the gas path 130 may be configured such that one or more of the pistons 110 may be centered on respective heat exchangers, but one or more other pistons 110 of the same thermodynamic circuit may not be centered on respective heat exchangers.

In some embodiments of device 100, the hot piston 110, along with the hot cylinder 120, and the cold piston 111, along with the cold cylinder 121, may be spatially offset from each other, that is, the hot piston 110 and the cold piston are not in line with each other. An example of such a configuration may be shown in FIG. 1C, described in more detail below. This configuration of FIG. 1C may include a straight-through gas path 130-*a* connecting cold piston 111-*d* and cold cylinder 121-*d* to hot piston 110-*c* and hot cylinder 120-*c* that are on the same thermodynamic circuit. This configuration may be hereinafter referred to as a mechanical offset configuration.

Some embodiments may include a mix of both a mechanical offset configuration and a thermal offset configuration. For example, the hot piston 110, along with the hot cylinder 120, and the cold piston 111, along with the cold cylinder 121, that are on different thermodynamic circuits may be offset spatially, that is, not in line with each other, and the hot piston 110, along with the hot cylinder 120, and some other cold piston, along with the cold cylinder it is contained within, that are on the same thermodynamic circuit may likewise be offset spatially, that is, not be in line with each other. This configuration may be hereinafter referred to as a hybrid offset configuration.

Figure 1B:
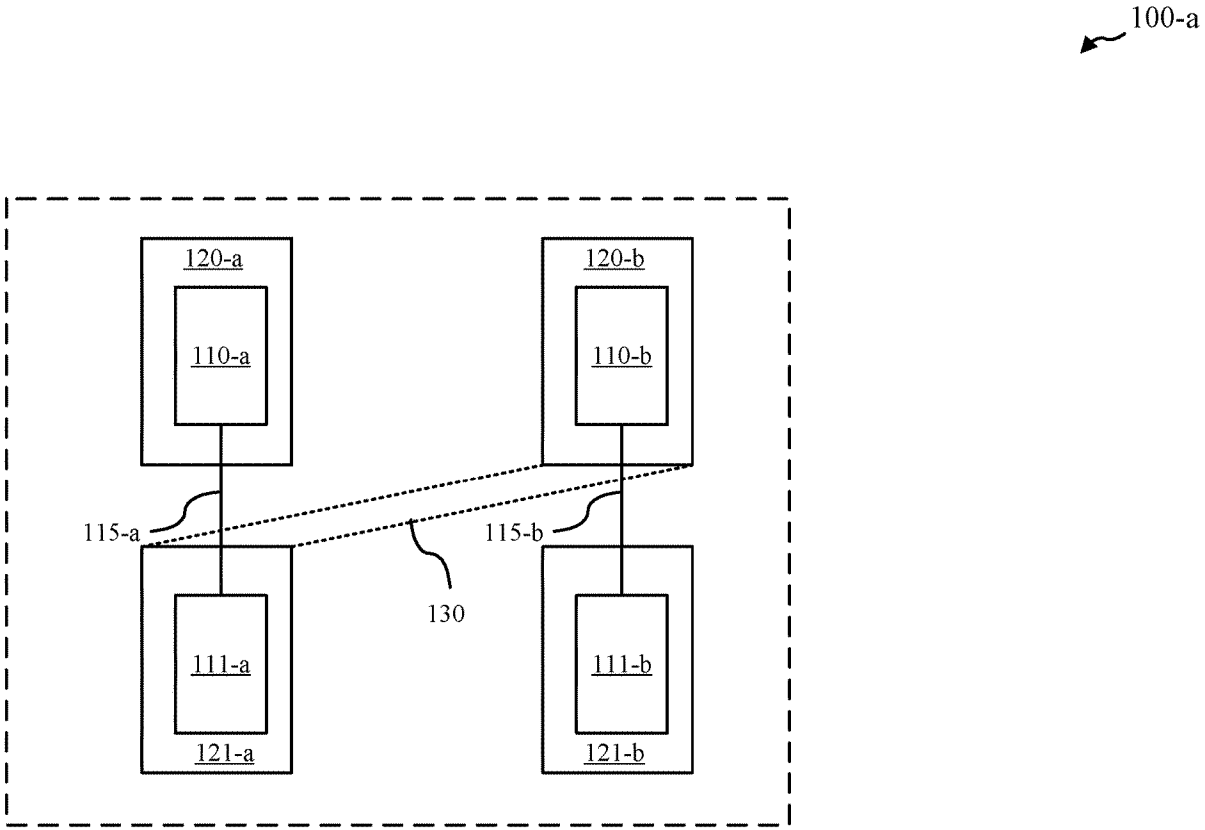
FIG. 1B shows a Stirling cycle device in accordance with various embodiments.
Figure 1C:
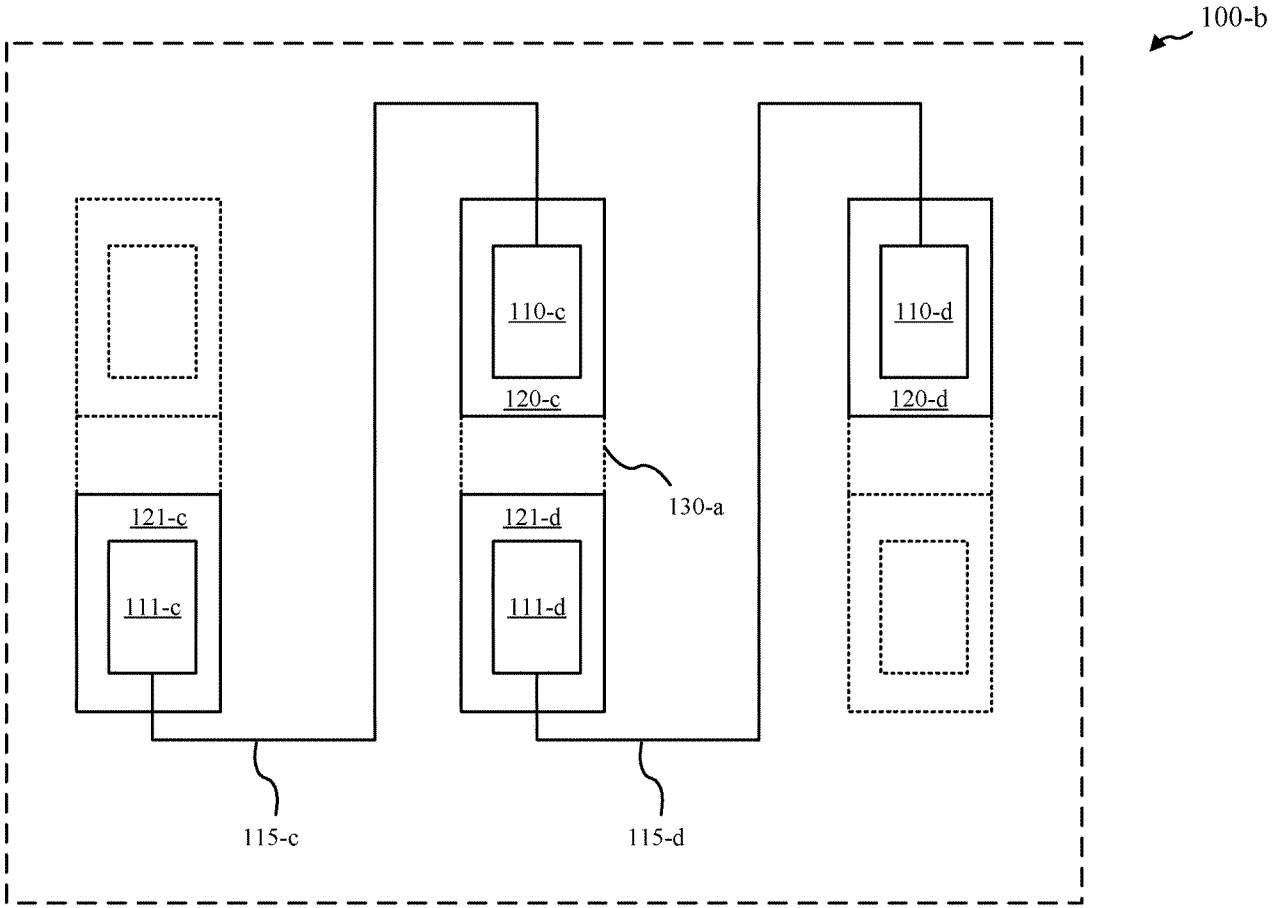
FIG. 1C shows a Stirling cycle device in accordance with various embodiments.

Turning now to FIG. 1B and FIG. 1C in more detail, Stirling cycle device 100-*a* of FIG. 1B and Stirling cycle device 100-*b* of FIG. 1C are provided in accordance with various embodiments. Devices 100-*a* and/or 100-*b* may be examples of device 100 of FIG. 1A. Device 100-*a* and device 100-*b* may show more pistons and/or cylinders compared to FIG. 1A. For example, device 100-*a* may include a first hot piston 110-*a* that may be contained within a first hot cylinder 120-*a* and a first cold piston 111-*a* that may be contained within first cold cylinder 121-*a*. Device 100-*b* may include a first hot piston 110-*c* contained within a first hot cylinder 120-*c* and a first cold piston 111-*c* contained within first cold cylinder 121-*c*. In addition, device 110-*a* and device 110-*b* may include at least a second hot piston 110-*b*, 110-*d*, respectively, contained within a second hot cylinder 120-*b*, 120-*d*, respectively. Device 110-*a* and device 100-*b* may have a second cold piston 111-*b*, 111-*d*, respectively, contained within a second cold cylinder 121-*b*, 121-*d*, respectively. The hot and cold pistons of device 100-*a* and/or device 100-*b* may be configured as single-acting alpha Stirling cycle devices in some cases.

With respect to device 100-*a*, a single actuator 115-*a* may mechanically couple the first hot piston 110-*a* with the first cold piston 111-*a* such that the first hot piston 110-*a* and the first cold piston 111-*a* may be on different thermodynamic circuits; the different thermodynamic circuits may be adjacent thermodynamic circuits. Similarly, a single actuator 115-*b* may mechanically couple the second hot piston 110-*b* with the second cold piston 111-*b* such that the first hot piston 110-*b* and the first cold piston 111-*b* may be on different thermodynamic circuits, which may also be adjacent thermodynamic circuits. The first cold piston 111-*a* and the second hot piston 110-*b* may be configured to be on the same thermodynamic circuit in some cases. For example, the first cold piston 111-*a* and the second hot piston 110-*b* of device 100-*a* may be coupled with a gas path 130. Gas path 130 may include one or more diffusers and/or one more heat exchangers in some cases. Device 100-*a* may show a configuration where the first cold piston 111-*a* and the second hot piston 110-*b* may be configured to be spatially offset from each other. This configuration may be referred to as a thermal offset configuration in some cases. Device 100-*a* may include additional pistons, cylinders, and/or gas paths not shown or explicitly called out with reference numbers.

With respect to device 110-*b*, a single actuator 115-*c* may mechanically couple the first hot piston 110-*c* coupled with the first cold piston 111-*c* such that the first hot piston 110-*c* and the first cold piston 111-*c* may be on different thermodynamic circuits, which may be adjacent circuits. A second single actuator 115-*d* may mechanically couple the second hot piston 110-*d* with the second cold piston 111-*d* such that the second hot piston 110-*d* and the second cold piston 111-*d* may be configured to be on different thermodynamic circuits, which also may be adjacent thermodynamic circuits. The second cold piston 111-*d* and the first hot piston 110-*c* may be configured to be on the same thermodynamic circuit in some cases. For example, the first hot piston 110-*c* and the second cold pistons 110-*d* of device 100-*b* may be coupled with a gas path 130-*a*. Gas path 130-*a* may include one or more diffusers and/or one more heat exchangers in some cases. Device 100-*b* may have a configuration where the second cold piston 111-*d* and the first hot piston 110-*c* may be configured to be spatially in line with each other in some cases. This configuration may be referred to as a mechanical offset configuration in some cases. Device 100-*b* may include additional pistons, cylinders, and/or gas paths not shown or explicitly called out with reference numbers.

Some embodiments may include a mix of both a mechanical offset configuration and a thermal offset configuration, combining aspects of device 100-*a* and device 100-*b*. For example, a hot piston and the hot cylinder it may be contained within along with a cold piston and the cold cylinder it may be contained within that are on different thermodynamic circuits may be offset spatially, that is, not in line with each other, and a hot piston and the hot cylinder it may be contained within along with a cold piston and the cold cylinder it may be contained within that are on the same thermodynamic circuit may likewise be offset spatially, that is, not be in line with each other. This configuration may be referred to as a hybrid offset configuration in some cases. In some cases, the hybrid offset configuration may have lower gas pressure drop and smaller dead volume within the thermodynamic circuit than the thermal offset configuration, thus promoting higher indicated efficiency and higher specific power output.

One may note that the devices 100 in general throughout the specification and figures may involve paired hot and cold pistons. Some embodiments may exchange the hot and cold pistons with respect to a given pair of pistons, but may not necessarily be shown or described herein, though are still within the spirit of the different embodiments.

Figure 2:
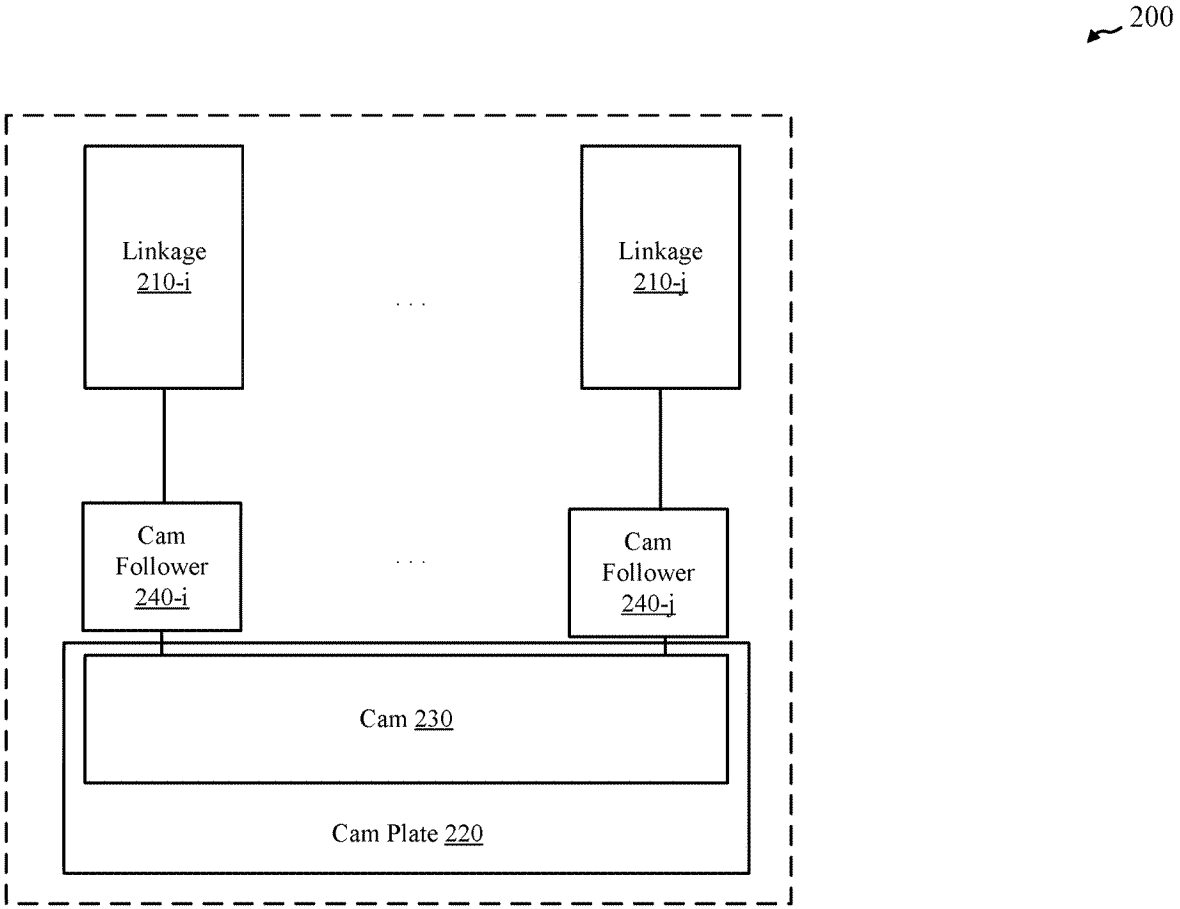
FIG. 2 shows a linear-to-rotary mechanism in accordance with various embodiments.

Turning now to FIG. 2, linear-to-rotary mechanism device 200 in accordance with various embodiments is provided. The linear-to-rotary mechanism 200 may provide for transferring the forces generated on pistons into torque on a shaft to drive a rotary permanent-magnet electric generator or induction motor, for example. The device 200 may include multiple linkages 210-*i*, 210-*j* for synthesizing linear or nearly linear motion. The device 200 may include a cam plate 220 coupled with the multiple linkages 210-*i*, 210-*j* utilizing a cam 230 and multiple cam followers 240-*i*, 240-*j*. While device 200 shows two linkages and two cam followers, other embodiments may include more linkages 210 and cam followers 240, such as three or four or more, for example. In some embodiments, the linkages 210-*i*, 210-*j* may include Watt linkages.

In some embodiments, the cam 230 and/or the multiple cam followers 240-*i*, 240-*j* are configured as conical surfaces. The cam 230 and the multiple cam followers 240-*i*, 240-*j* may be configured such that the apexes of all their respective conical surfaces may be coincident. An axis of the cam 230 and a respective axis of each of the multiple cam followers 240-*i*, 240-*j* may be inclined with respect to an axis of rotation of a main shaft. The multiple apexes of the conical surfaces may lie on the axis of rotation of the main shaft. In some cases, there may thus be no skidding at the contact interface between the cam 230 and the cam followers 240-*i*, 240-*j*, as the motion may be that of one cone rolling around another. In some embodiments, a bevel gear may be added to each of the cam 230 and the multiple cam followers 240-*i*, 240-*j*, the opening angle of the pitch cone of each bevel gear equaling the opening angle of the cone defining the conical surface to which each bevel gear is referenced, and the apexes of all pitch cones being coincident with the apexes of all conical surfaces. Such an enhancement may help avoid circumferential slippage that may otherwise occur at the contact interface between the smooth conical surfaces due to the angular acceleration and deceleration of the cam followers 240-*i*, 240-*j*.

In some cases, Watt linkages may synthesize a highly accurate, nearly straight line motion at the point on its center link where actuators may be attached. In some embodiments, the straightness of this point's motion may be better than one part in a thousand of the distance traveled, which may be the piston stroke length. This may minimize side loads between the pistons and cylinders and thus may minimize the friction losses and wear resulting therefrom, producing both a highly efficient and a highly reliable mechanism. In some embodiments, each cam follower 240-*i*, 240-*j* may be mounted on the input link of the Watt linkage which, as the main shaft rotates the cam plate and cam (the axis of whose conical surface being tilted with respect to the axis of main shaft), may thus swing in an arc about an axis which may intersect the axis of rotation of the main shaft at the point where the apexes of the conical surfaces of the cam and cam followers are coincident. In a Stirling cycle device and/or system having an even number of thermodynamic circuits equally spaced on a circle, the input links of those Watt linkages directly across from each other may move exactly opposite of each other, and hence may be joined into a single part in some cases. Joining these two input links into a single part may eliminate a need for there otherwise to be two cam followers for each input link, one in rolling contact with a first, say, the top, conical surface of the cam, to push the input link, the other in rolling contact with a second, say, the bottom, conical surface of the cam and opposite the first conical surface, to pull the input link, because although the input link of one Watt linkage can be pushed by a single cam follower in rolling contact with, say, the first conical surface of the cam in one direction only, this input link may be pulled in the opposite direction by a single cam follower identically configured on the input link of the opposite Watt linkage so as to be in rolling contact with the same, first conical surface of the cam. The cam 230 thus may involve actuating only half as many cam followers as in the barrel-cam design, which may involve one cam follower to push each carriage in one direction and a second cam follower to pull the carriage in the opposite direction. In general, with the input links of pairs of Watt linkages directly across from each other joined, there may involve only one surface on the cam 230 that the cam followers 240-*i*, 240-*j* may contact. Compared to a barrel-cam design, the Watt linkage design may involve only about half the number of bearing interfaces, which may include the interfaces not only between wheels and their corresponding axles, but also between wheels and the corresponding surfaces they roll on, which for the barrel-cam design may general include the guide rails that constrain the carriage motion to be linear. The Watt linkage design may be lighter as well. Because the cam plate 220 and cam followers 240-*i*, 240-*j* each may have a simple, conical profile, they may be easier to fabricate accurately, with simpler tools, than the barrel cam, which may involve two sinusoidal profiles, one on each opposing face of the barrel, each profile located with respect to each other with particular accuracy.

In some embodiments, the multiple linkages 210-*i*, 210-*j* are configured to couple a first single actuator and a second single actuator with each other at least to drive the first single actuator and the second single actuator or to be driven by the first single actuator and the second single actuator while maintaining a phase relationship between the first single actuator and the second single actuator.

Figure 3A:
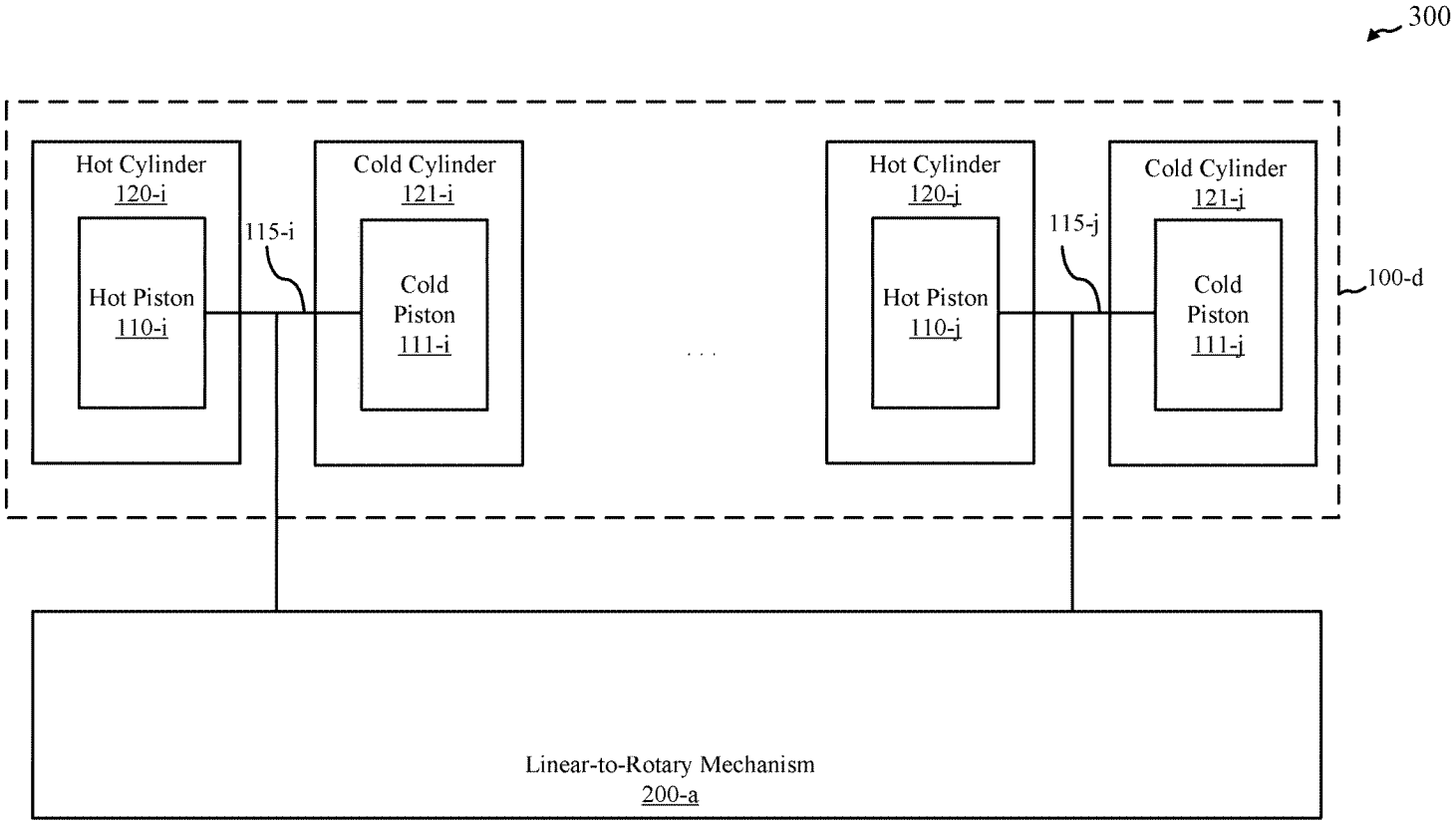
FIG. 3A shows Stirling cycle system in accordance with various embodiments.

FIG. 3A shows a Stirling cycle system 300 in accordance with various embodiments. The system 300 may include multiple paired pistons 110-*i*, 111-*i*/110-*j*, 111-*j* contained within multiple cylinders 120-*i*, 121-*i*/120-*j*, 121-*j*, respectively. Each of the paired pistons may include a hot piston 110-*i*, 110-*j* mechanically coupled with a cold piston 111-*i*, 111-*j* by mechanically coupling each with a single actuator 115-*i*, 115-*j* such that the hot piston and the cold piston are configured to be on different thermodynamic circuits. The different thermodynamic circuits may also be adjacent thermodynamic circuits. In some embodiments of system 300, the multiple paired pistons are configured as a single-acting alpha Stirling configuration. The multiple paired pistons, multiple cylinders, and actuators may be referred to as a Stirling cycle device 100-*d*, which may be an example of the Stirling cycle devices 100 of FIG. 1A, 100-*a* of FIG. B, and/or 100-*b* of FIG. 1C, for example. Some embodiments of system 300 may include more paired pistons and actuators than shown in FIG. 3A; for example, some embodiments may include three sets of pair pistons and actuators, four sets of paired pistons and actuators; some embodiments may include more pair pistons and actuators.

The system 300 may also include a linear-to-rotary mechanism 200-*a* coupled with the multiple single actuators 115-*i*, 115-*j*. In some embodiments, the linear-to-rotary mechanism 200-*a* includes a barrel cam and carriage mechanism. In some embodiments, the linear-to-rotary mechanism 200-*a* includes a linkage mechanism for synthesizing linear or nearly linear motion. Examples of such a linear-to-rotary mechanism may be shown in FIG. 2. For example, linear-to-rotary mechanism 200-*a* may be an example of linear-to-rotary mechanism 200 of FIG. 2. The linear-to-rotary mechanism 200-*a* may be configured to couple the multiple single actuators 115-*i*, 115-*j* with each other at least to drive the single actuators or to be driven by the actuators while maintaining a phase relationship between the single actuators. In some embodiments, the linear-to-rotary mechanism 200-*a* configured as linkage mechanism includes multiple linkages and a cam plate coupled with the multiple linkages utilizing a cam and multiple cam followers. In some embodiments, the linkages may include Watt linkages.

Figure 3B:
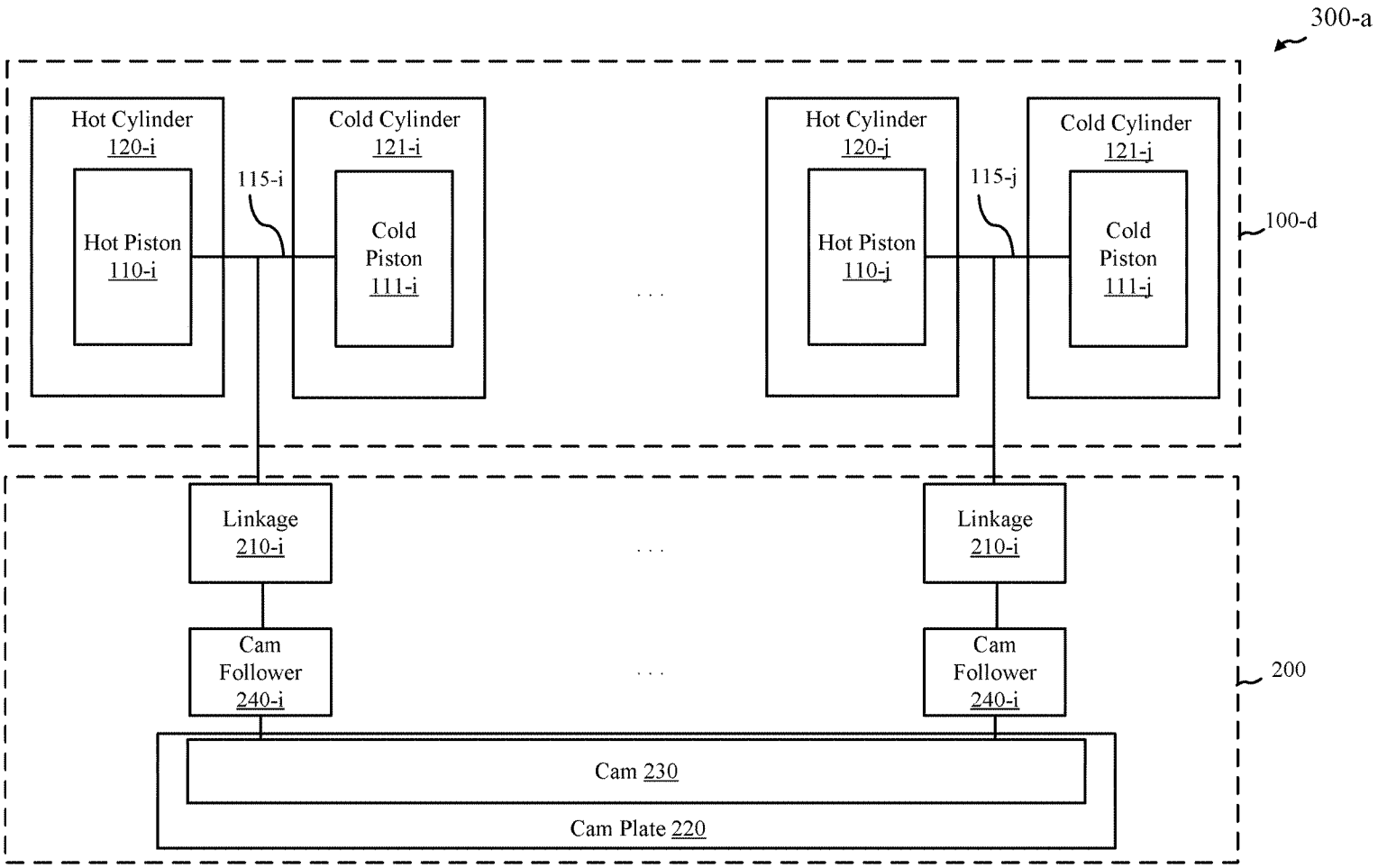
FIG. 3B shows Stirling cycle system in accordance with various embodiments.

Merely by way of example, FIG. 3B shows a Stirling cycle system 300-*a* in accordance with various embodiments. System 300-*a* may be a specific example of system 300 of FIG. 3. System 300-*a* may show Stirling cycle device 100-*d* from FIG. 3A coupled with linear-to-rotary mechanism 200 of FIG. 2. The multiple actuators 115-*i*, 115-*j* may couple the Stirling cycle device 100-*d* to the linear-to-rotary mechanism 200.

Figure 4A:
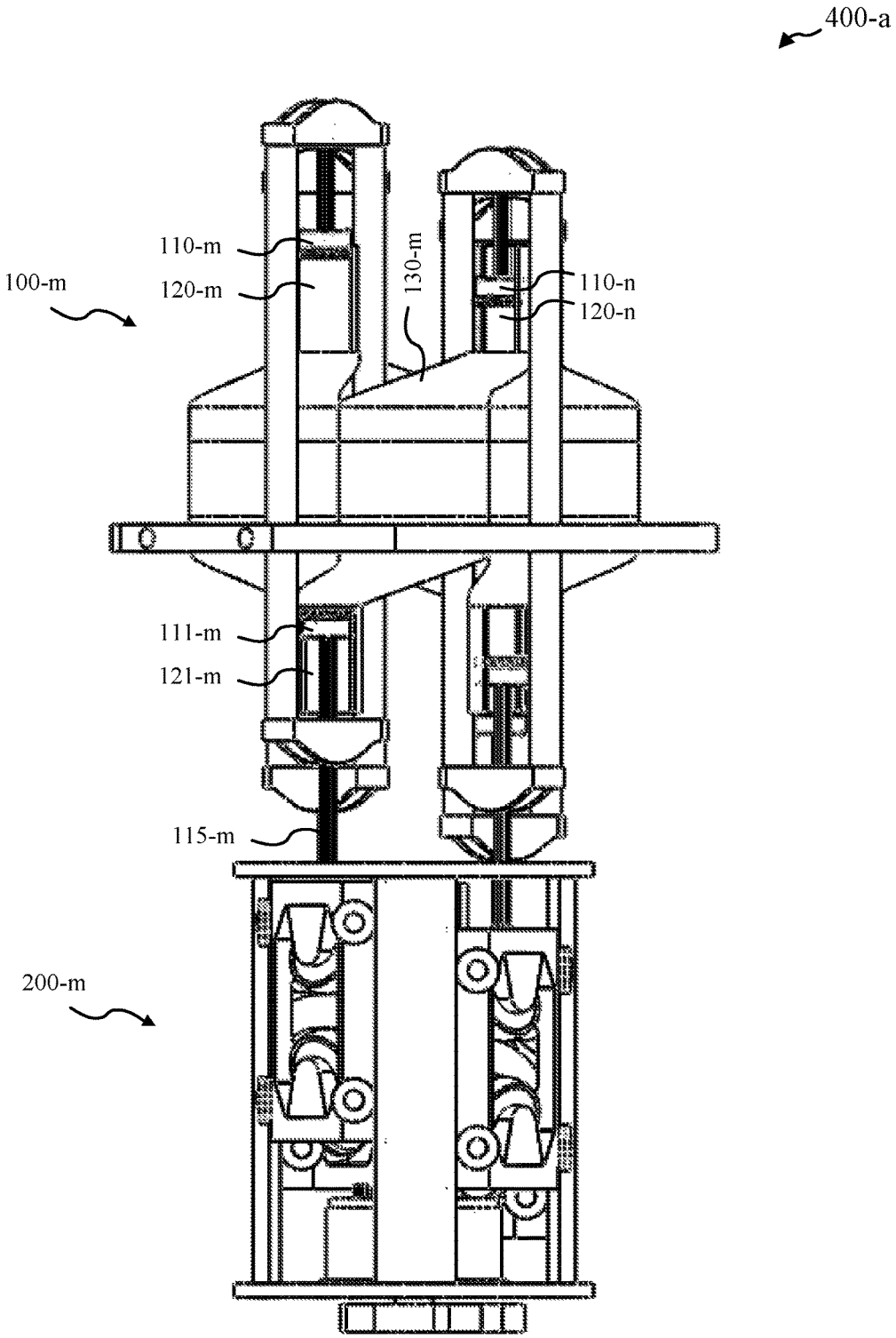
FIG. 4A shows a Stirling cycle system in accordance with various embodiments.
Figure 4B:
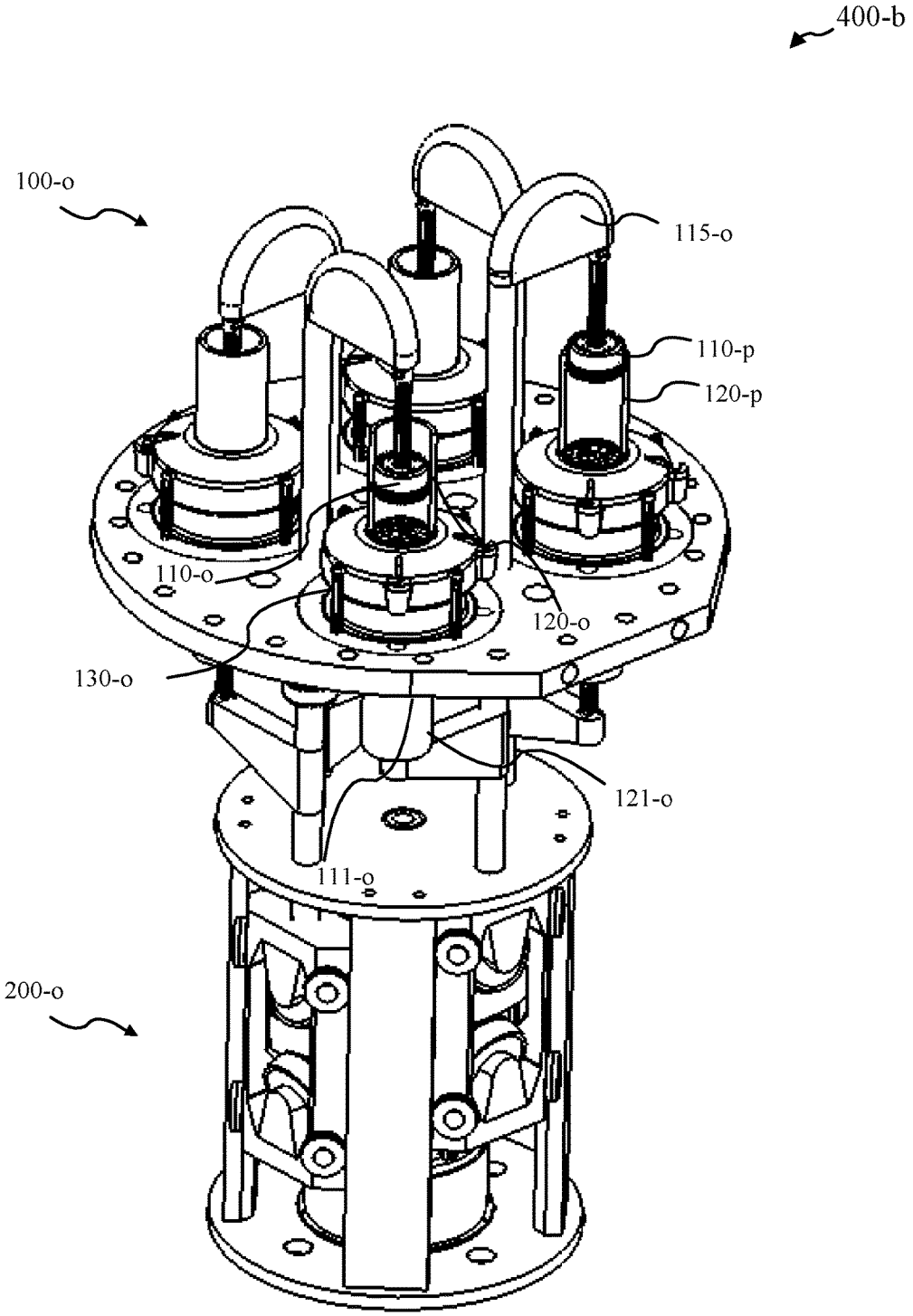
FIG. 4B shows a Stirling cycle system in accordance with various embodiments.
Figure 4C:
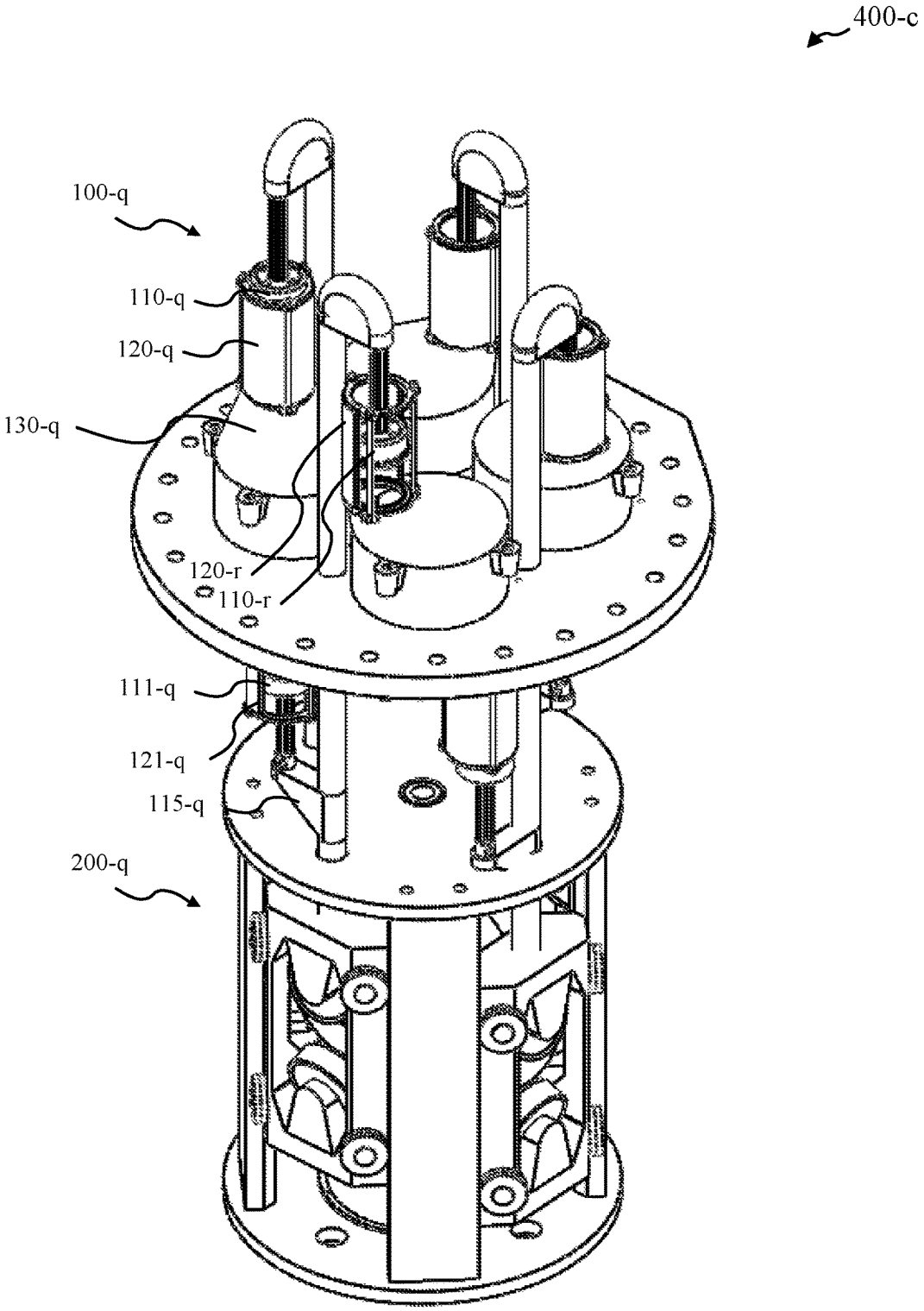
FIG. 4C shows a Stirling cycle system in accordance with various embodiments.

Turning now to FIG. 4A, FIG. 4B, and FIG. 4C, Stirling cycle systems 400-*a*, 400-*b*, and 400-*c*, respectively, are provided in accordance with various embodiments. These different embodiments may provide a variety of functions. For example, systems 400-*a*, 400-*b*, and/or 400-*c* may provide correct phase relationships between the pistons for each system in accordance with various embodiments. Furthermore, systems 400-*a*, 400-*b*, and/or 400-*c* may provide for transferring the forces generated on the pistons into torque on a shaft to drive or be driven by a rotary permanent-magnet electric machine or induction motor, for example. In some cases, aspects of systems 400-*a*, 400-*b*, and 400-*c* may be shown as cutaway views with respect to one or more pistons and one or more cylinders in order to show the one or more pistons within the one or more cylinders.

Systems 400-*a*, 400-*b*, and/or 400-*c* may provide examples of single-acting alpha Stirling cycle designs in accordance with various embodiments. These designs may have high performance and/or reliability that may be utilized for applications having low temperature heat sources, for example. In some cases, rotary machines may have lower costs at larger sizes, which may be due to the more economical shape of the external pressure vessel, and may have higher thermal efficiency and/or specific power output, due to smaller losses from convective heat transfer between the hot and cold regions within the Stirling cycle device and/or system, which may be easily isolated from each other in such designs. In some cases, having both sets of hot and cold pistons attached to a single linear-to-rotary mechanism may reduce cost, mass, and/or size significantly. In some embodiments, the connection from the linear-to-rotary mechanism to each cold piston may be a simple connecting rod, and/or the connection from the linear-to-rotary mechanism to each hot piston may be a rigid assembly, such as a bail.

Systems 400-*a*, 400-*b*, and 400-*c* provide three variations of the barrel cam and carriage configuration. In general, the carriage of the barrel cam and carriage mechanism may inherently generate straight-line motion, which may prevent side loads on the pistons; there may, however, be residual slippage at a rolling interface between the barrel cam surface and the cam followers. These systems may be modified in accordance with various embodiments to utilize other mechanisms besides the barrel cam and carriage configuration. For example, other embodiments may utilize mechanisms having multiple linkages for synthesizing linear or nearly linear motion coupled to a cam plate utilizing a cam and multiple cam followers. In some embodiments, the linkages may include Watt linkages. Watt linkages may generate nearly straight line motion, but may avoid residual slippage at the rolling interface between its cam and cam followers, in contrast to the carriage of the barrel cam and carriage mechanism.

Systems 400-*a*, 400-*b*, and 400-*c* may provide three thermo-mechanical variants of a barrel cam and carriage configuration having four thermodynamic circuits. For example, system 400-*a* may provide a 90 degree bent gas path 130-*m* between hot cylinder 120-*n* and cold cylinder 121-*m* on the same thermodynamic circuit, which may be referred to as a thermal offset. Gas path 130-*m* may include one or more diffusers and/or heat exchangers. With respect to system 400-*a*, this example of a thermal offset configuration may involve a hot piston 110-*m*, with associated hot cylinder 120-*m*, on one thermodynamic circuit and cold piston 111-*m*, with associated cold cylinder 121-*m*, on an adjacent thermodynamic circuit being in line on the same single actuator 115-*m*, but hot and cold pistons on the same thermodynamic circuit, such as hot piston 110-*n* and cold piston 111-*m*, not being in line. The pistons, cylinders, and/or actuators of system 400-*a* may be configured as a Stirling cycle device 100-*m*, which may be an example of device 100 of FIG. 1A, device 100-*a* of FIG. 1B, and/or device 100-*d* of FIG. 3A or FIG. 3B. Device 100-*m* may include additional pistons, cylinders, actuators, and/or gas paths that may be shown, but not called out, and/or may be obscured from view. For example, device 100-*m* may be configured to utilize four hot and cold piston pairs and their associated cylinders, actuators, and/or gas paths in some embodiments.

System 400-*b* may provide a straight-through gas path 130-*o*, connecting hot cylinder 120-*o* and cold cylinder 121-*o* on the same thermodynamic circuit, which may be referred to as a mechanical offset. Gas path 130-*o* may include one or more diffusers and/or heat exchangers. With respect to system 400-*b*, hot piston 110-*p*, with associated hot cylinder 120-*p*, on one thermodynamic circuit and cold piston 111-*o*, with associated cold cylinder 121-*o*, on an adjacent thermodynamic circuit may be offset on the same single actuator 115-*o*, and/or hot and cold pistons, such as hot piston 110-*o* and cold piston 111-*o* on the same thermodynamic circuit may be in line. It may be assumed that the actuator 115-*o*, while shown notionally to effect the offset of hot piston 110-*p* with respect to cold piston 111-*o*, may be constructed sufficiently rigid so as to prevent side loads from developing between hot piston 110-*p* and cold piston 111-*o* and their respective cylinders 120-*p* and 121-*o*. The pistons, cylinders, and/or actuators of system 400-*b* may be configured as a Stirling cycle device 100-*o*, which may be an example of device 100 of FIG. 1A, device 100-*b* of FIG. 1C, and/or device 100-*d* of FIG. 3A or FIG. 3B. Device 100-*o* may include additional pistons, cylinders, actuators, and/or gas paths that may be shown, but not called out, and/or may be obscured from view. For example, device 100-*o* may be configured to utilize four hot and cold piston pairs and their associated cylinders, actuators, and/or gas paths in some embodiments.

System 400-*c* may provide a hybrid of the thermal offset and the mechanical offset configurations, which may combine a bent gas path 130-*q* with a single actuator 115-*q* whose hot piston 110-*r* and cold piston 111-*q* are offset spatially, that is, not in line with each other, and which may be referred to as a hybrid offset configuration. Gas path 130-*q* may include one or more diffusers and/or heat exchangers. A hybrid offset configuration, such as system 400-*c*, may include hot piston 110-*r*, contained within hot cylinder 120-*r*, on one thermodynamic circuit, and cold piston 111-*q*, contained within cold cylinder 121-*q*, on an adjacent thermodynamic circuit, which pistons and cylinders may be offset spatially on the same actuator 115-*q*, and therefore may not be in line with each other, while hot piston 110-*q*, contained within hot cylinder 120-*q*, and cold piston 111-*q*, contained within cold cylinder 121-*q*, on the same thermodynamic circuit but on different actuators may also be offset spatially and therefore may not be in line with each other. It may be assumed that the actuator 115-*q*, while shown notionally to effect the offset of hot piston 110-*r* with respect to cold piston 111-*q*, may be constructed sufficiently rigid so as to prevent side loads from developing between hot piston 110-*r* and cold piston 111-*q* and their respective cylinders 120-*r* and 121-*q*. The pistons, cylinders, and/or actuators of system 400-*c* may be configured as a Stirling cycle device 100-*q*, which may be an example of device 100 of FIG. 1A, device 100-*d* of FIG. 3A, and/or device 100-*e* of FIG. 3B. Device 100-*q* may include additional pistons, cylinders, actuators, and/or gas paths that may be shown, but not called out, and/or may be obscured from view. For example, device 100-*q* may be configured to utilize four hot and cold piston pairs and their associated cylinders, actuators, and/or gas paths in some embodiments.

Each of the three variants described above with respect to systems 400-*a*, 400-*b*, and 400-*c* can be implemented utilizing a variety of linear-to-rotary mechanisms, shown as mechanisms 200-*m*, 200-*o*, and 200-*q*, respectively. Mechanisms 200-*m*, 200-*o*, and 200-*q* may shown a variant of the barrel cam and carriage. Some embodiments may utilize a linkage mechanism for synthesizing linear or nearly linear motion coupled with a cam plate or swash plate. Mechanisms 200-*m*, 200-*o*, and/or 200-*q* may be an example of linear-to-rotary mechanism 200 of FIG. 2 or FIG. 3B, and/or mechanism 200-*a* of FIG. 3A, in some embodiments.

Figure 5A:
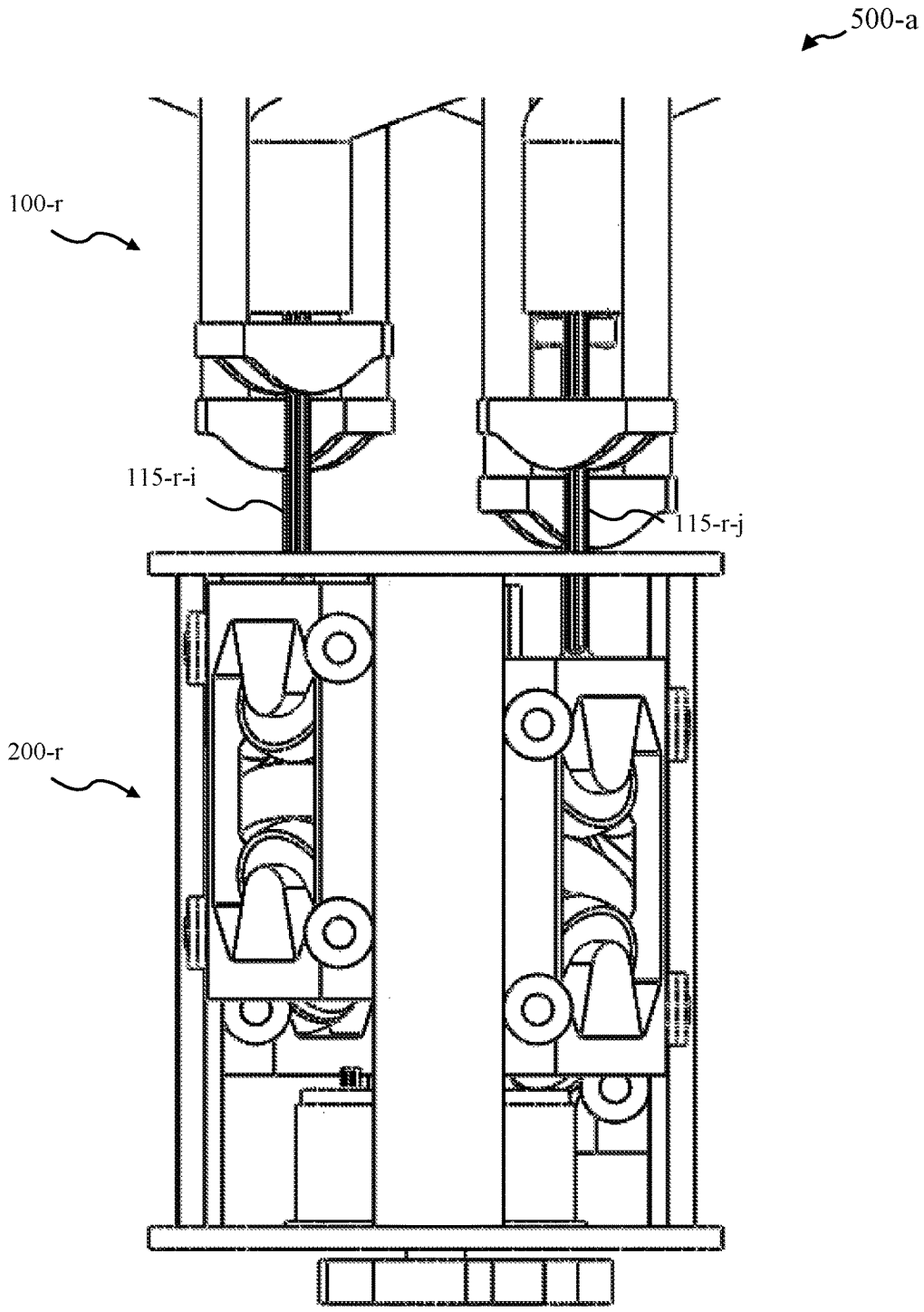
FIG. 5A shows aspects of a Stirling cycle system in accordance with various embodiments.
Figure 5B:
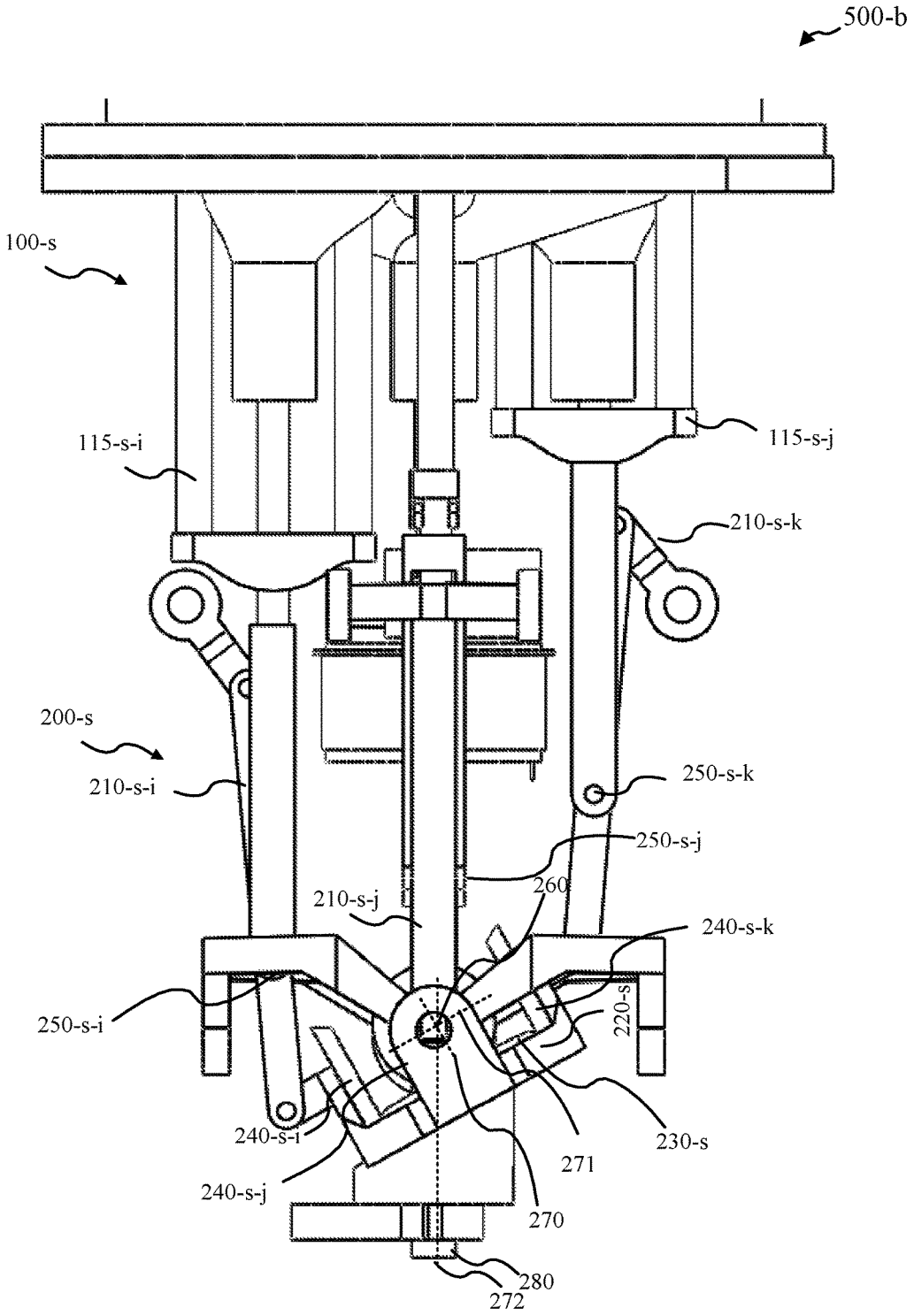
FIG. 5B shows aspects of a Stirling cycle system in accordance with various embodiments.

In FIG. 5A and FIG. 5B, systems 500-*a* and 500-*b* show two different examples of linear-to-rotary mechanisms 200-*r* and 200-*s*, respectively, in accordance with various embodiments. FIG. 5A and FIG. 5B may also show portions of Stirling cycle device 100-*r* and 100-*s*, respectively, which may be examples of device 100 of FIG. 1A, device 100-*a* of FIG. 1B, device 100-*b* of FIG. 1C, device 100-*d* of FIG. 3A or FIG. 3B, device 100-*m* of FIG. 4A, device 100-*o* of FIG. 4B, and/or device 100-*q* of FIG. 4C.

FIG. 5A shows a linear-to-rotary mechanism 200-*r* that may utilize a barrel cam and carriage configuration in accordance with various embodiments. Mechanism 200-*r* may be an example of linear-to-rotary mechanism 200-*a* of FIG. 3A, mechanism 200-*m* of FIG. 4A, mechanism 200-*o* of FIG. 4B, and/or mechanism 200-*q* of FIG. 4C. The linear-to-rotary mechanism 200-*r* may couple to the Stirling cycle device 100-*r* via the one or more single actuators 115-*r*-*i*, 115-*j*-*i* of the device 100-*r* (two other single actuators may be obscured from view or not specifically called out).

FIG. 5B shows a linear-to-rotary mechanism 200-*s* that may utilize multiple linkages for synthesizing linear or nearly linear motion, configured as Watt linkages, and a cam plate with multiple cam followers. Mechanism 200-*s* may include Watt linkages 210-*s*-*i*, 210-*s*-*j*, 210-*s*-*k* (a fourth Watt linkage may be included, but is obscured from view) that produce nearly linear motion at pivot points 250-*s*-*i*, 250-*s*-*j*, 250-*s*-*k* (a fourth pivot point may be included, but is obscured from view), cam followers 240-*s*-*i*, 240-*s*-*j*, 240-*s*-*k* (a fourth cam follower may be included, but is obscured from view), and cam 230-*s* that may be part of cam plate 220-*s*. In some embodiments, cam 230-*s* and/or multiple cam followers 240-*s*-*i*, 240-*s*-*j*, 240-*s*-*k* are configured as conical surfaces. Cam 230-*s* and multiple cam followers 240-*s*-*i*, 240-*s*-*j*, 240-*s*-*k* may be configured such that apexes 260 of all their respective conical surfaces may be coincident. An axis 270 of cam 230-*s* and a respective axis 271 of each of the multiple cam followers 240-*s*-*i*, 240-*s*-*j*, 240-*s*-*k* may be inclined with respect to an axis 272 of rotation of a main shaft 280. The multiple apexes 260 of the conical surfaces may lie on the axis 272 of rotation of the main shaft 280. In some embodiments, a bevel gear may be added to each of the cam 230-*s* and the multiple cam followers 240-*s*-*i*, 240-*s*-*j*, 240-*s*-*k*, the opening angle of the pitch cone of each bevel gear equaling the opening angle of the cone defining the conical surface to which each bevel gear is referenced, and the apexes of all pitch cones being coincident with the apexes 260 of all conical surfaces. Such an enhancement may help avoid circumferential slippage that may otherwise occur at the contact interface between the smooth conical surfaces. In some embodiments, the motion of the cam followers 240-*s*-*i*, 240-*s*-*j*, 240-*s*-*k* may impart rotation to the cam plate 220-*s* about the axis 272 of the main shaft 280. The conical surfaces of the cam 230-*s* and multiple cam followers 240-*s*-*i*, 240-*s*-*j*, 240-*s*-*k* may make contact to facilitate the motion of a conical surface rolling on another conical surface. This may promote the cam followers 240-*s*-*i*, 240-*s*-*j*, 240-*s*-*k* to remain in contact with the cam 230-*s* without slipping or sliding. Mechanism 200-*s* may be an example of linear-to-rotary mechanism 200 of FIG. 2 or FIG. 3B, and/or mechanism 200-*a* of FIG. 3A. The mechanism 200-*s* may couple with the Stirling cycle device 100-*s* through the one or more single actuators 115-*s*-*i*, 115-*s*-*j* of device 100-*s* (two other single actuators may be obscured from view or not specifically called out).

Figure 5C:
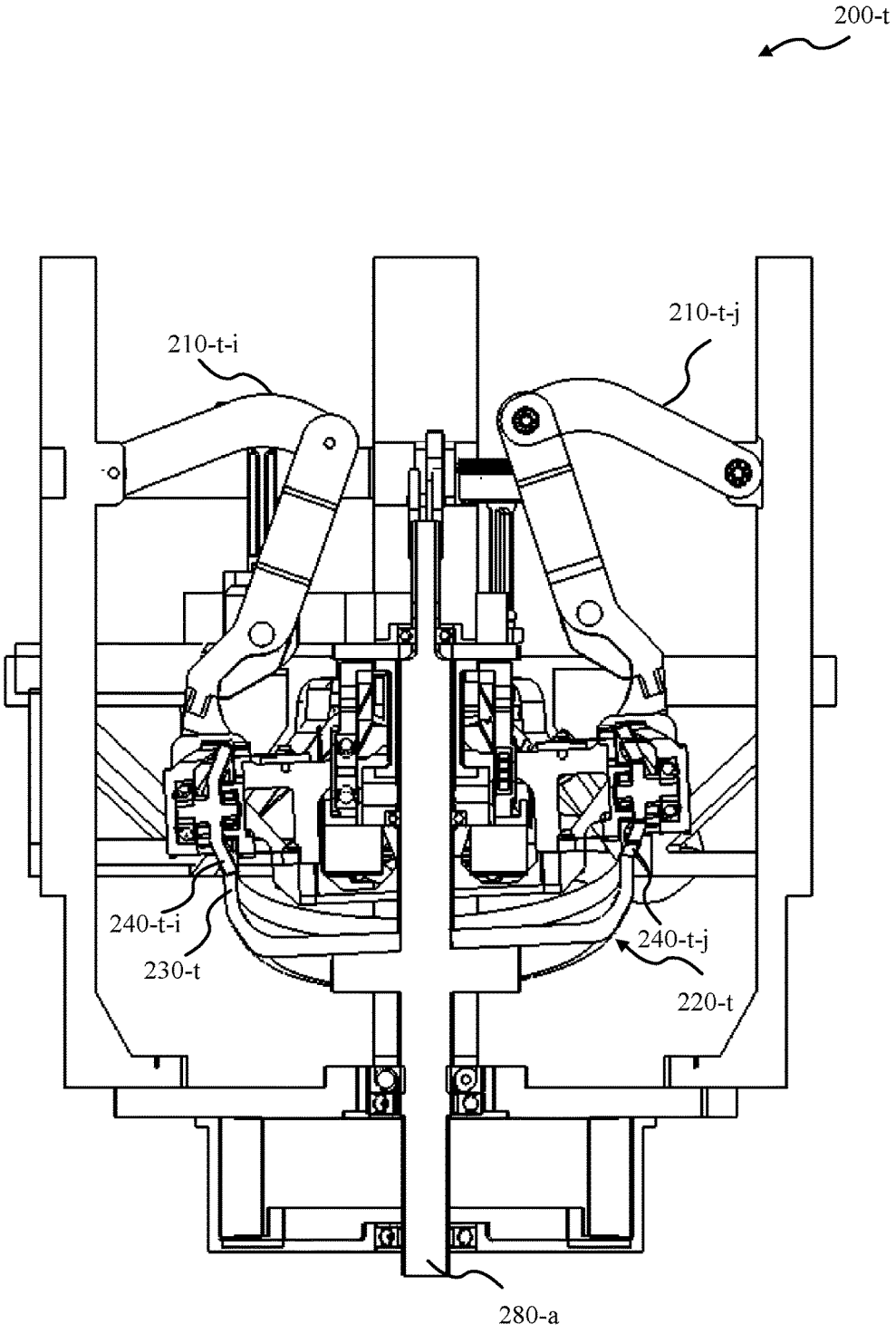
FIG. 5C shows a linear-to-rotary mechanism in accordance with various embodiments.

FIG. 5C provides an additional example of a linear-to-rotary mechanism 200-*t* that may utilize multiple Watt linkages and a cam plate configuration in accordance with various embodiments. Mechanism 200-*t* of FIG. 5C may include multiple Watt linkages, such as Watt linkages 210-*t*-*i* and 210-*t*-*j* (one or more additional Watt linkages may be included in mechanism 200-*t*, though may be obscured from view). Mechanism 200-*t* may include multiple cam followers, such as cam followers 240-*t*-*i* and 240-*t*-*j* (one or more additional cam followers may be included in mechanism 200-*t*, though may be obscured from view). Mechanism 200-*t* cam 230-*t* that may be part of cam plate 220-*t*. Mechanism 200-*t* may be an example of linear-to-rotary mechanism 200 of FIG. 2 or FIG. 3B, mechanism 200-*a* of FIG. 3A, and/or mechanism 200-*s* of FIG. 5B. Watt linkages 210-*t*-*i* and 210-*t*-*j* and cam plate mechanism 220-*t*, the cam 230-*t* and/or the multiple cam followers 240-*t*-*i* and 240-*t*-*j* may be configured as conical surfaces. The cam 230-*t* and the multiple cam followers 240-*t*-*i* and 240-*t*-*j* may be configured such that the apexes of all their respective conical surfaces may be coincident. An axis of the cam 230-*t* and a respective axis of each of the multiple cam followers 240-*t*-*i* and 240-*t*-*j* may be inclined with respect to an axis of rotation of a main shaft 280-*a*. The multiple apexes of the conical surfaces may lie on the axis of rotation of the main shaft 280-*a*.

Figure 5D:
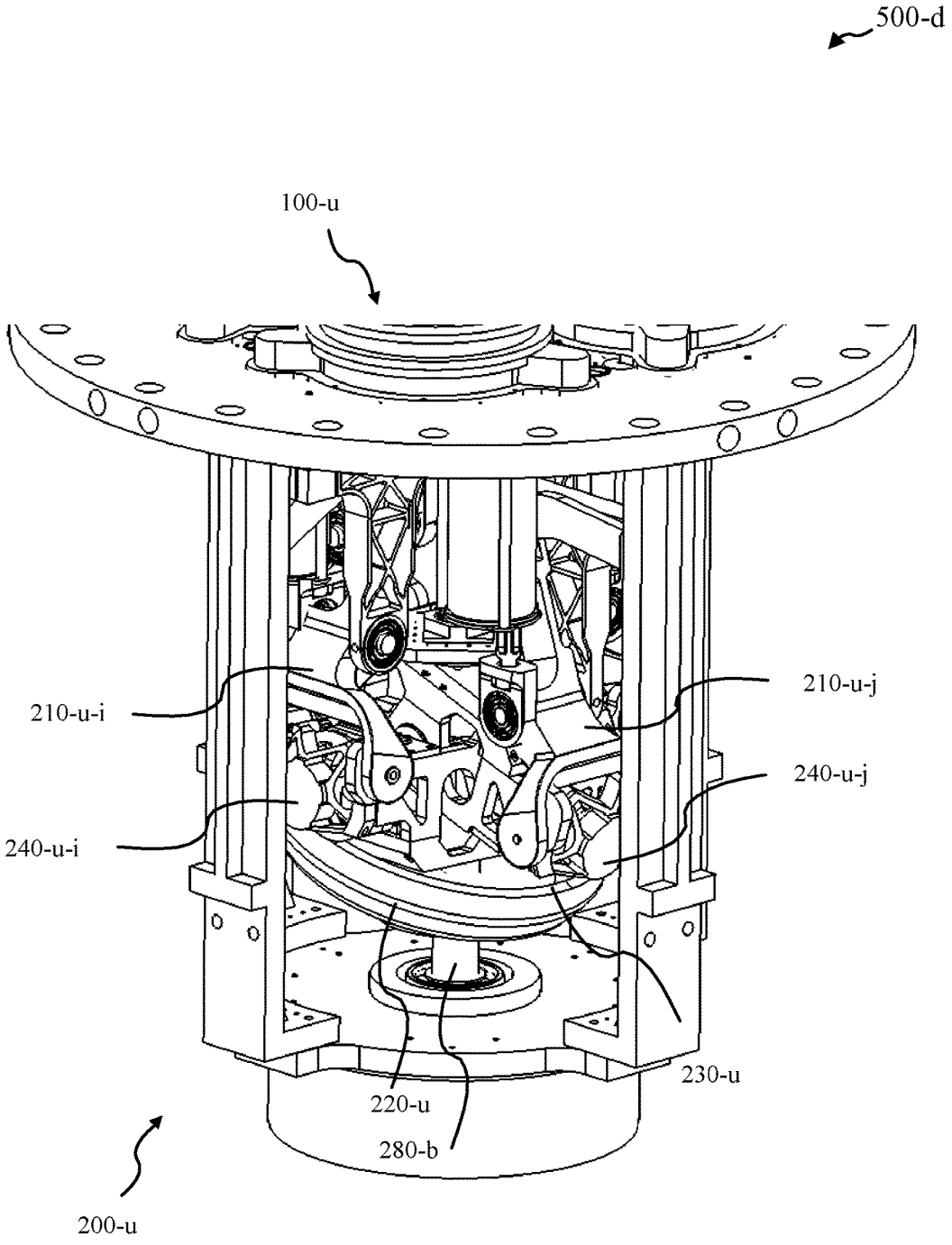
FIG. 5D shows aspects of a Stirling cycle system in accordance with various embodiments.

FIG. 5D provides another example of a system 500-*d* that may include linear-to rotary mechanisms 200-*u* that may utilize multiple Watt linkages and a cam plate configuration in accordance with various embodiments. Mechanism 200-*u* of FIG. 5D may include Watt linkages 210-*u*-*i* and 210-*u*-*j* (a third and fourth Watt linkage may be included, but may be obscured from view), cam followers 240-*u*-*i* and 240-*u*-*j*, (a third and a fourth cam follower may be included, but may be obscured from view), and cam 230-*u* that may be part of cam plate 220-*u*. The motion of the cam followers 240-*u*-*i* and 240-*u*-*j* may impart rotation to the cam plate 220-*u* about the axis of a main shaft 280-*b*. In some embodiments, the conical surfaces of the cam 230-*u* and multiple cam followers 240-*u*-*i* and 240-*u*-*j* may make contact to facilitate the motion of a conical surface rolling on another conical surface. Mechanism 200-*u* may be an example of linear-to-rotary mechanism 200 of FIG. 2, mechanism 200-*a* of FIG. 3A, mechanism 200-*b* of FIG. 3B, mechanism 200-*s* of FIG. 5B, and/or mechanism 200-*t* of FIG. 5C. System 500-*d* may show aspects of Stirling cycle device 100-*u*, which may be examples of device 100 of FIG. 1A, device 100-*a* of FIG. 1B, device 100-*b* of FIG. 1C, device 100-*d* of FIG. 3A or FIG. 3B, device 100-*m* of FIG. 4A, device 100-*o* of FIG. 4B, and/or device 100-*q* of FIG. 4C.

Figure 5E:
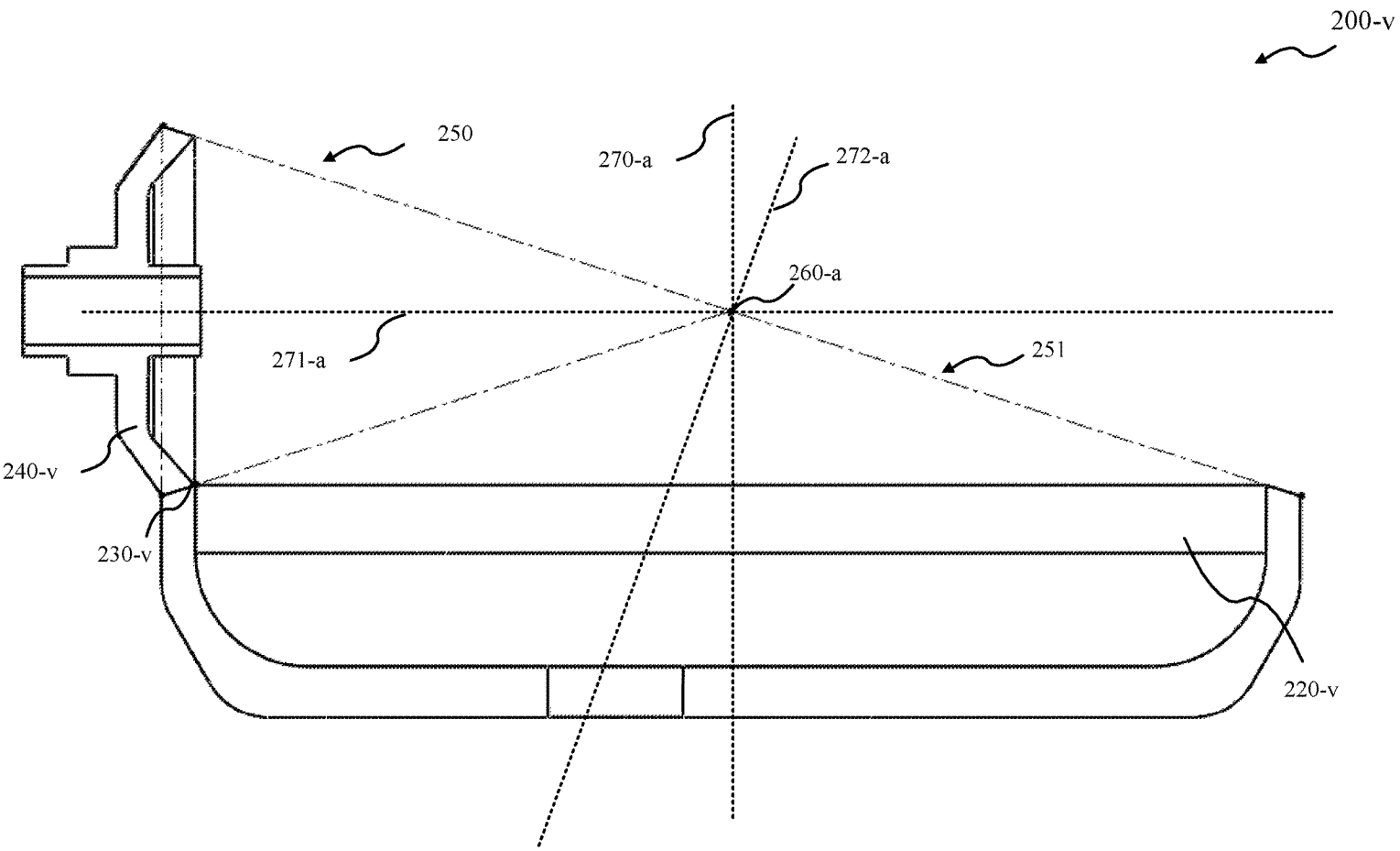
FIG. 5E shows aspects of a linear-to-rotary mechanism in accordance with various embodiments.

FIG. 5E shows aspects of a linear-to-rotary mechanism 200-*v* that may utilize a cam plate configuration in accordance with various embodiments. Mechanism 200-*v* may show a cam follower 240-*v* (one or more additional cam followers may be included in mechanism 200-*v*, though not shown). Mechanism 200-*v* may include cam 230-*v* that may be part of cam plate 220-*v*. Mechanism 200-*t* may be an example of aspects of linear-to-rotary mechanism 200 of FIG. 2 or FIG. 3B, mechanism 200-*a* of FIG. 3A, mechanism 200-*s* of FIG. 5B, mechanism 200-*t* of FIG. 5C, and/or mechanism 200-*u* of FIG. 5D, for example.

The cam 230-*v* and/or the cam follower 240-*v* may be configured with conical surfaces and shown with respect to cones 250 and 251. The cam 230-*v* and the cam follower 240-*v* may be configured such that the apexes 260-*a* of all their respective conical surfaces may be coincident. An axis 270-*a* of the cam 230-*v* and an axis 271-*a* of the cam follower 240-*v* may be inclined with respect to an axis 272-*a* of rotation of a main shaft. The multiple coincident apexes 260-*a* of the conical surfaces may lie on the axis 272-*a* of rotation of the main shaft. In some embodiments, the motion of the cam follower 240-*v* may help impart rotation to the cam plate 220-*v* about the axis 272-*a* of the main shaft. The conical surfaces of the cam 230-*v* and the cam follower 240-*v* may make contact to facilitate the motion of a conical surface rolling on another conical surface. This may promote the cam follower 240-*v* to remain in contact with the cam 230-*v* without slipping or sliding. For clarity purposes, only one cam follower 240-*v* is shown in this figure, though additional cam followers may be utilized in some embodiments as is shown in other figures, for example.

Figure 6A:
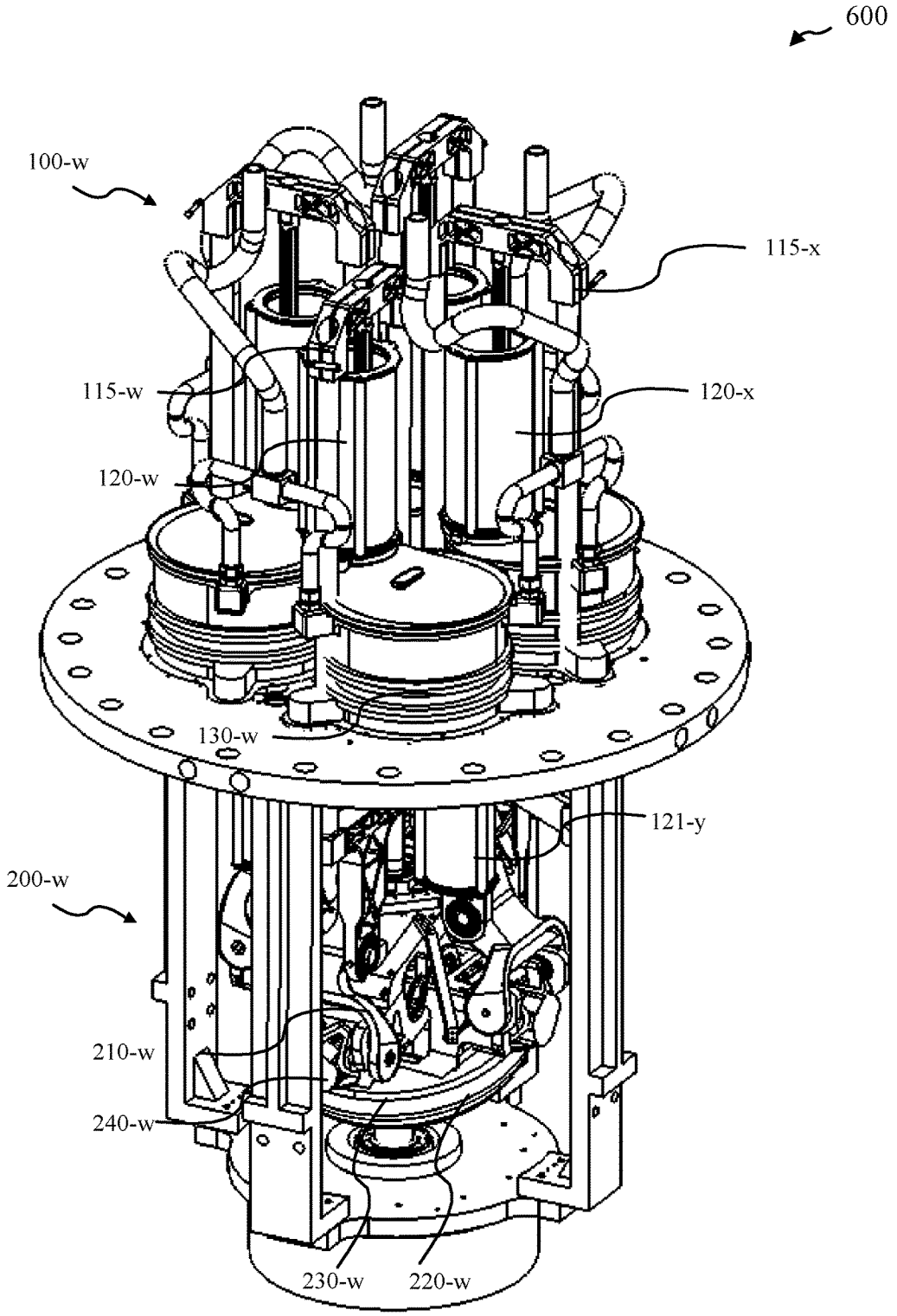
FIG. 6A shows a Stirling cycle system in accordance with various embodiments.
Figure 6B:
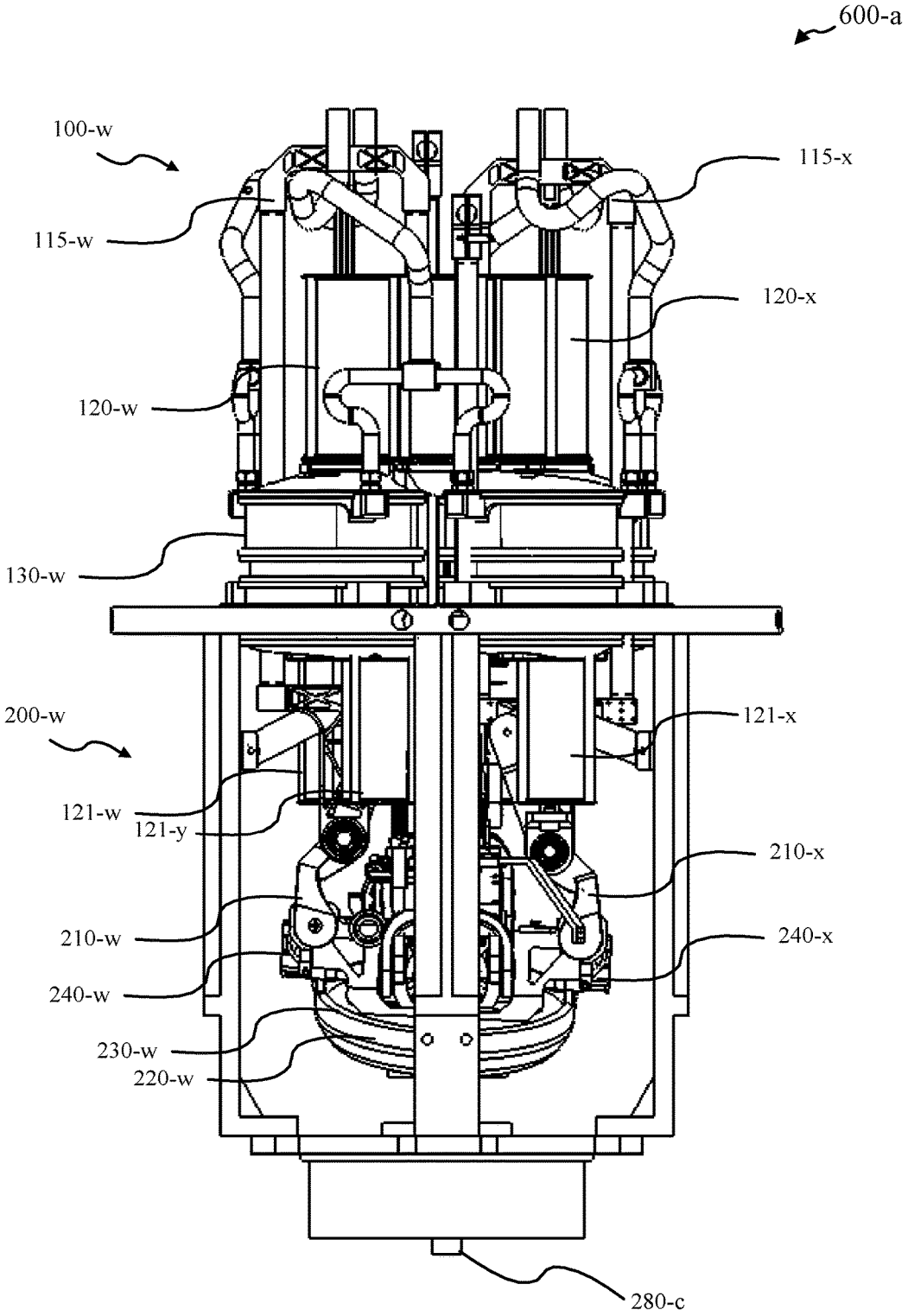
FIG. 6B shows a Stirling cycle system in accordance with various embodiments.

Turning now to FIG. 6A and FIG. 6B, an isometric view of a Stirling cycle system 600 with a related side view of a Stirling cycle system 600-*a* are provided in accordance with various embodiments. System 600-*a* may provide an example of system 600 of FIG. 6A, for example. The Stirling cycle systems 600 and 600-*a* may be examples of system 300 of FIG. 3A or system 300-*a* of FIG. 3B. The systems 600 and 600-*a* may include a Stirling cycle device 100-*w*. Stirling cycle device 100-*w* may be an example of aspects of Stirling cycle device 100 of FIG. 1A, device 100-*a* of FIG. 1B, device 100-*b* of FIG. 1C, device 100-*d* of FIG. 3A or FIG. 3B, device 100-*m* of FIG. 4A, device 100-*o* of FIG. 4B, device 100-*q* of FIG. 4C, device 100-*r* of FIG. 5A, device 100-*s* of FIG. 5B, and/or device 100-*u* of FIG. 5D. The systems 600 and 600-*a* may include a linear-to-rotary mechanism 200-*w*, which may be an example of aspects of linear-to-rotary mechanism 200 of FIG. 2 or FIG. 3B, mechanism 200-*a* of FIG. 3A, mechanism 200-*s* of FIG. 5B, mechanism 200-*t* of FIG. 5C, mechanism 200-*u* of FIG. 5D, and/or mechanism 200-*v* of FIG. 5E.

The systems 600 and 600-*a* may include multiple paired pistons contained within multiple cylinders; for example, these embodiments may in general include four paired pistons with an associate cylinder for each piston, though not all of these pistons and cylinders may be specifically called out with reference numbers. Furthermore, the pistons may be obscured from view as they may be contained with respective cylinders. Each of the paired pistons may include a hot piston mechanically coupled with a cold piston by mechanically coupling each to a single actuator such that the hot piston and the cold piston are configured to be on different thermodynamic circuits, which may also be adjacent thermodynamic circuits. For example, a hot piston within hot cylinder 120-*w* may be mechanically coupled with a cold piston within cold cylinder 121-*w* utilizing single actuator 115-*w*. Similarly, hot piston within a hot cylinder 120-*x* may be mechanically coupled with a cold piston within cold cylinder 121-*y* utilizing single actuator 115-*x*. Systems 600 and 600-*a* may include two other single actuators that may be obscured from view or not specifically called out. Furthermore, cold piston within cold cylinder 121-*y* and hot piston within hot cylinder 120-*w* may be configured to be on the same thermodynamic circuit in some cases. Similarly, cold piston within cold cylinder 121-*x* and hot piston within hot cylinder 120-*x* may be configured to be on the same thermodynamic circuit in some cases. This configuration may be referred to as a hybrid offset configuration in some cases, where hot piston within hot cylinder 120-*w* and cold piston within cold cylinder 121-*w* and/or hot piston within hot cylinder 120-*w* and cold piston within cold cylinder 121-*y* may be configured to be spatially offset from each other, respectively. Similarly, hot piston within hot cylinder 120-*x* and cold piston within cold cylinder 121-*x* may be configured to be spatially offset from each other. For example, cold piston within cold cylinder 121-*y* and hot piston within hot cylinder 120-*w* may be coupled with a gas path 130-*w*. Gas path 130-*w* may include one or more diffusers and/or one more heat exchangers in some cases. Systems 600 and 600-*a* may include in general three additional gas paths that may be obscured from view or not specifically called out. Additional pistons and cylinders may be called out, though some pistons and cylinders may be obscured from view or not specifically called out.

In some embodiments of systems 600 and 600-*a*, the multiple paired pistons are configured as a single-acting alpha Stirling configuration. In general, each hot piston/cold piston pair may be mechanically coupled with a single actuator on different thermodynamic circuits, which may be adjacent thermodynamic circuits. In addition, each hot piston may have an associated cold piston that it may not be mechanically coupled with on the same actuator, but configured such that these associated pistons are on the same thermodynamic circuit.

The systems 600 and 600-*a* may also include a linear-to-rotary mechanism 200-*w* coupled with at least the multiple single actuators 115-*w*, 115-*x*. In this example, the linear-to-rotary mechanism 200-*w* may include a linkage mechanism for synthesizing linear or nearly linear motion. The linkage mechanism may be configured to couple the multiple single actuators with each other at least to drive the single actuators or to be driven by the actuators while maintaining a phase relationship between the single actuators. In some embodiments, the linkage mechanism includes multiple linkages and a cam plate coupled with the multiple linkages utilizing a cam and multiple cam followers. In some embodiments, the linkages may include Watt linkages. For example, Watt linkage 210-*w* may be coupled with cam follower 240-*w*, which may be coupled with cam 230-*w*. Cam 230-*w* may be part of cam plate 220-*w*. Similarly, Watt linkage 210-*x* may be coupled with cam follower 240-*x*, which may be coupled with cam 230-*w*. System 600 may include additional Watt linkages and/or cam followers that may not be explicitly called out, but may be shown in FIG. 6B, though some Watt linkages and/or cam followers may be obscured from view.

The cam 230-*w* and/or cam followers 240-*w* and 240-*x* may be configured with conical surfaces. The cam 230-*w* and cam followers 240-*w* and 240-*x* may be configured such that the apexes of all their respective conical surfaces may be coincident. An axis of the cam 230-*w* and a respective axis of each cam follower 240-*w* and 240-*x* may be inclined with respect to an axis of rotation of a main shaft 280-*c*. The multiple coincident apexes of the conical surfaces may lie on the axis of rotation of the main shaft 280-*c*. In some embodiments, the motion of the cam followers 240-*w* and 240-*x* may help impart rotation to the cam plate 220-*w* about the axis of the main shaft 280-*c*. The conical surfaces of the cam 230-*w* and cam followers 240-*w* and 240-*x* may make contact to facilitate the motion of a conical surface rolling on another conical surface. This may promote the cam followers 240-*w* and 240-*x* to remain in contact with the cam 230-*w* without slipping or sliding.

Figure 7:
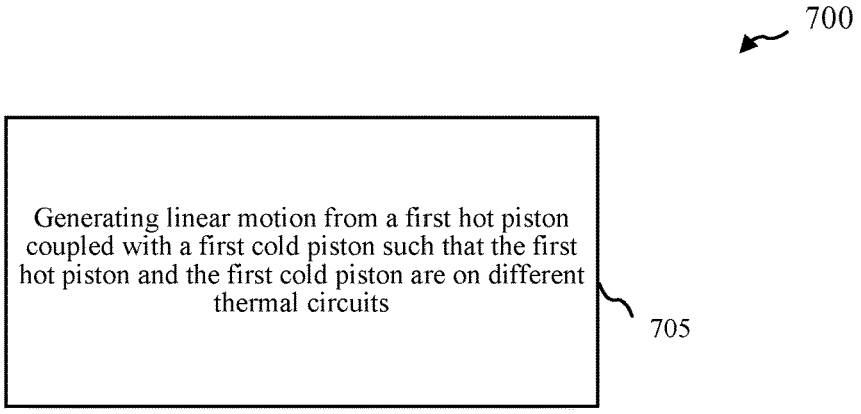
FIG. 7 is a flow diagram of a method in accordance with various embodiments.

Turning now to FIG. 7, a flowchart of a method 700 is provided in accordance with various embodiments. Method 700 may be implemented utilizing aspects of device 100 of FIG. 1A, device 100-*a* of FIG. 1B, device 100-*b* of FIG. 1C, device 100-*d* of FIG. 3A or FIG. 3B, device 100-*m* of FIG. 4A, device 100-*o* of FIG. 4B, device 100-*q* of FIG. 4C, device 100-*r* of FIG. 5A, device 100-*s* of FIG. 5B, device 100-*u* of FIG. 5D, and/or device 100-*w* of FIG. 6A or FIG. 6B. In FIG. 7, the specific selection of steps shown and the order in which they are shown is intended merely to be illustrative. It is possible for certain steps to be performed in alternative orders, for certain steps to be omitted, and for certain additional steps to be added according to different embodiments of the invention. Some but not all of these variants are noted in the description that follows.

At block 705, a first hot piston, which may be contained within a first hot cylinder, and a first cold piston, which may be contained within a first cold cylinder, may generate linear motion. The first cold piston may be mechanically coupled with the first hot piston such that they are different thermodynamic circuits. In some cases, a first single actuator may couple the first hot piston with the first cold piston. The different thermodynamic circuits may include adjacent thermodynamic circuits.

In some embodiments of method 700, the first hot piston and the first cold piston are configured to be spatially in line with each other. In some embodiments, the first hot piston and the first cold piston are configured to be spatially offset from each other.

In some embodiments of method 700, at least a second hot piston contained within a second hot cylinder and a second cold piston contained within a second cold cylinder are provided, which may also generate linear motion. A second single actuator may mechanically the second hot piston with the second cold piston such that the second hot piston and the second cold piston may be configured to be on different thermodynamic circuits, which also may be adjacent thermodynamic circuits. The first cold piston and the second hot piston may be configured to be on the same thermodynamic circuit in some cases. The first cold piston and the second hot piston may be configured to be spatially in line with each other in some cases. The first cold piston and the second hot piston may be configured to be spatially offset from each other in some cases. The first cold piston and second hot piston may be configured as part of a single-acting alpha Stirling cycle configuration.

Figure 8:
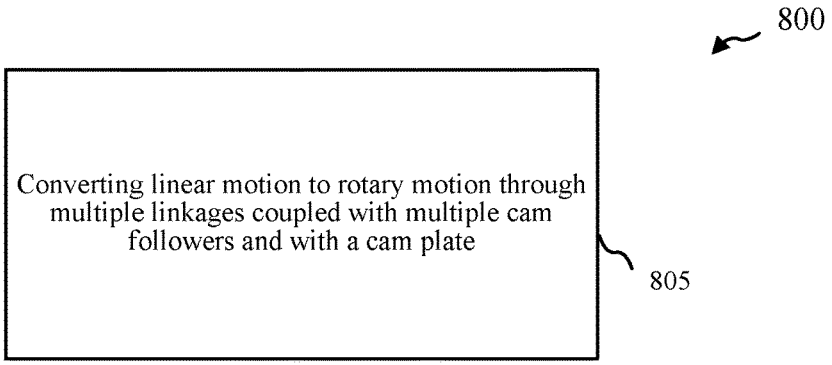
FIG. 8 is a flow diagram of a method in accordance with various embodiments.

FIG. 8 provides an overview of a flowchart of a method 800 in accordance with various embodiments. Method 800 may be implemented utilizing linear-to-rotary mechanism 200 of FIG. 2 or FIG. 3B, mechanism 200-*a* of FIG. 3, mechanism 200-*s* of FIG. 5B, mechanism 200-*t* of FIG. 5C, mechanism 200-*u* of FIG. 5D, mechanism 200-*v* of FIG. 5E, and/or mechanism 200-*w* of FIG. 6A or FIG. 6B. In FIG. 8, the specific selection of steps shown and the order in which they are shown is intended merely to be illustrative. It is possible for certain steps to be performed in alternative orders, for certain steps to be omitted, and for certain additional steps to be added according to different embodiments of the invention. Some but not all of these variants are noted in the description that follows. Method 800 may be combined with method 700 of FIG. 7 such that the linear motion generated in method 700 may be converted to the rotary motion of method 800.

At block 805, multiple Watt linkages coupled with multiple cam followers and with a cam of a cam plate may convert linear motion to rotary motion.

In some embodiments of method 800, the cam and the multiple cam followers are configured as conical surfaces. The cam and the multiple cam followers may be configured such that the apexes of all their respective conical surfaces may be coincident. An axis of the cam and a respective axis of each of the multiple cam followers may be inclined with respect to an axis of rotation of a main shaft. The multiple apexes of the conical surfaces may lie on the axis of rotation of the main shaft. In some embodiments, a bevel gear may be added to each of the cam and the multiple cam followers, the opening angle of the pitch cone of each bevel gear equaling the opening angle of the cone defining the conical surface to which each bevel gear is referenced, and the apexes of all pitch cones being coincident with the apexes of all conical surfaces. Such an enhancement may help avoid circumferential slippage that may otherwise occur at the contact interface between the smooth conical surfaces.

Figure 9:
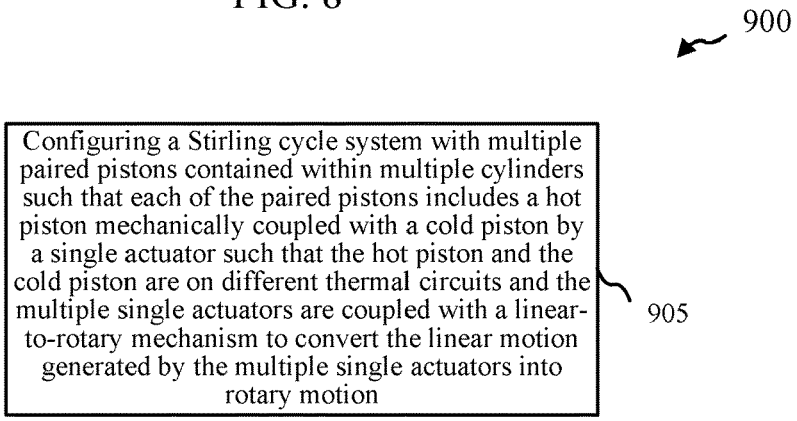
FIG. 9 is a flow diagram of a method in accordance with various embodiments.

FIG. 9 provides an overview of a flowchart of a method 900 of utilizing a Stirling cycle system in accordance with various embodiments. Method 900 may be implemented utilizing device 100 of FIG. 1A, device 100-*a* of FIG. 1B, device 100-*b* of FIG. 1C, device 100-*d* of FIG. 3A or FIG. 3B, device 100-*m* of FIG. 4A, device 100-*o* of FIG. 4B, device 100-*q* of FIG. 4C, device 100-*r* of FIG. 5A, device 100-*s* of FIG. 5B, device 100-*u* of FIG. 5D, and/or device 100-*w* of FIG. 6A or FIG. 6B. Method 900 may be implemented utilizing linear-to-rotary mechanism 200 of FIG. 2 or FIG. 3B, mechanism 200-*a* of FIG. 3, mechanism 200-*m* of FIG. 4A, mechanism 200-*o* of FIG. 4B, mechanism 200-*q* of FIG. 4C, mechanism 200-*r* of FIG. 5A, mechanism 200-*s* of FIG. 5B, mechanism 200-*t* of FIG. 5C, mechanism 200-*u* of FIG. 5D, mechanism 200-*v* of FIG. 5E, and/or mechanism 200-*w* of FIG. 6A or FIG. 6B. In FIG. 9, the specific selection of steps shown and the order in which they are shown is intended merely to be illustrative. It is possible for certain steps to be performed in alternative orders, for certain steps to be omitted, and for certain additional steps to be added according to different embodiments of the invention. Some but not all of these variants are noted in the description that follows.

At block 905, a Stirling cycle system may be configured with multiple paired pistons contained within multiple cylinders. Each of the paired pistons may include a hot piston mechanically coupled with a cold piston by mechanically by a single actuator such that the hot piston and the cold piston are configured to be on different thermodynamic circuits, which may also be adjacent thermodynamic circuits. The multiple single actuators may be coupled with a linear-to-rotary mechanism to convert the linear motion generated by the multiple single actuators into rotary motion. In some embodiments of the method 900, the multiple paired pistons are configured as a single-acting alpha Stirling configuration.

In some embodiments the method 900, the linear-to-rotary mechanism includes a barrel cam and carriage mechanism. In some embodiments, the linear-to-rotary mechanism includes a linkage mechanism for synthesizing linear or nearly linear motion. The linkage mechanism may be configured to couple the multiple single actuators with each other at least to drive the single actuators or to be driven by the actuators while maintaining a phase relationship between the single actuators. In some embodiments, the linkage mechanism includes multiple linkages and a cam plate coupled with the multiple linkages utilizing a cam and multiple cam followers. In some embodiments, the linkages may include Watt linkages.

While detailed descriptions of one or more embodiments have been given above, various alternatives, modifications, and equivalents will be apparent to those skilled in the art without varying from the spirit of the different embodiments. Moreover, except where clearly inappropriate or otherwise expressly noted, it should be assumed that the features, devices, and/or components of different embodiments may be substituted and/or combined. Thus, the above description should not be taken as limiting the scope of the different embodiments, which may be defined by the appended claims.

What is claimed is:

1. A Stirling cycle system comprising:

a first hot piston contained within a first hot cylinder, wherein the first hot piston and the first hot cylinder are components of a first thermodynamic circuit;

a first cold piston contained within a first cold cylinder, wherein the first cold piston and the first cold cylinder are components of a second thermodynamic circuit; and a first single actuator configured to couple the first hot piston with the first cold piston;

a second hot piston contained within a second hot cylinder, wherein the second hot piston and the second hot cylinder are components of the second thermodynamic circuit;

a second cold piston contained within a second cold cylinder, wherein the second cold piston and the second cold cylinder are components of a third thermodynamic circuit;

a second single actuator configured to couple the second hot piston with the second cold piston; and a linear-to-rotary mechanism coupled with at least the first single actuator or the second single actuator, wherein the linear-to-rotary mechanism includes:

a plurality of Watt linkages; and a cam plate coupled with the plurality of Watt linkages utilizing a cam and a plurality of cam followers.

2. The system of claim 1, wherein the first thermodynamic circuit and the second thermodynamic circuit comprise adjacent thermodynamic circuits.

3. The system of claim 1, wherein the first hot piston and the first cold piston are spatially in line with each other.

4. The system of claim 1, wherein the first hot piston and the first cold piston are spatially offset from each other.

5. The system of claim 1, wherein the second thermodynamic circuit and the third thermodynamic circuits comprise adjacent thermodynamic circuits.

6. The system of claim 1, wherein the first cold piston and the second hot piston are spatially in line with each other.

7. The system of claim 1, wherein the first cold piston and the second hot piston are spatially offset from each other.

8. The system of claim 1, wherein the first cold piston and second hot piston are part of a single-acting alpha Stirling cycle configuration.

9. The system of claim 1, wherein the cam and plurality of cam followers are configured as conical surfaces.

10. The system of claim 9, wherein each respective conical surface has a respective apex and the cam and the plurality of cam followers are configured such that each of the plurality of apexes is coincident with each other.

11. The system of claim 10, wherein an axis of the cam and a respective axis of each of the plurality of cam followers are inclined with respect to an axis of rotation of a main shaft.

12. The system of claim 11, wherein the plurality of apexes of the conical surfaces lie on the axis of rotation of the main shaft.

13. The system of claim 1, wherein at least two of the plurality of Watt linkages are mechanically coupled with each other.

14. The system of claim 1, wherein the plurality of Watt linkages are configured to couple the first single actuator and the second single actuator with each other through the cam plate at least to drive the first single actuator and the second single actuator or to be driven by the first single actuator and the second single actuator while maintaining a phase relationship between the first single actuator and the second single actuator.

15. A Stirling cycle system comprising:

a first hot piston contained within a first hot cylinder, wherein the first hot piston and the first hot cylinder are components of a first thermodynamic circuit;

a first cold piston contained within a first cold cylinder, wherein the first cold piston and the first cold cylinder are components of a second thermodynamic circuit; and a first single actuator configured to couple the first hot piston with the first cold piston such that the first hot piston and the first cold piston are spatially offset from each other such that the first hot piston moves along a first line of motion and the first cold piston moves along a second line of motion, wherein the first line of motion is parallel with the second line of motion.

16. The system of claim 15, further comprising a linear-to-rotary mechanism coupled with the first actuator, wherein the linear-to-rotary mechanism includes a plurality of linkages synthesizing linear or nearly-linear motion.

17. The system of claim 15, further comprising a linear-to-rotary mechanism coupled with the first actuator, wherein the linear-to-rotary mechanism includes a barrel cam and carriage mechanism.

18. A Stirling cycle system comprising:

a first hot piston contained within a first hot cylinder, wherein the first hot piston and the first hot cylinder are components of a first thermodynamic circuit;

a first cold piston contained within a first cold cylinder, wherein the first cold piston and the first cold cylinder are components of a second thermodynamic circuit;

a first single actuator configured to couple the first hot piston with the first cold piston;

a second hot piston contained within a second hot cylinder, wherein the second hot piston and the second hot cylinder are components of the second thermodynamic circuit;

a second cold piston contained within a second cold cylinder, wherein the second cold piston and the second cold cylinder are components of a third thermodynamic circuit;

a second single actuator configured to couple the second hot piston with the second cold piston; and a linear-to-rotary mechanism coupled with at least the first single actuator or the second single actuator, wherein the linear-to-rotary mechanism includes:

a plurality of linkages; and a cam plate coupled with the plurality of linkages utilizing a cam and a plurality of cam followers, wherein an axis of the cam and a respective axis of each of the plurality of cam followers are inclined with respect to an axis of rotation of a main shaft.

19. The system of claim 18, wherein the axis of the cam and the respective axis of each of the plurality of cam followers intersect at a point located on the axis of rotation of the main shaft.

20. The system of claim 19, wherein the cam and plurality of cam followers are configured as conical surfaces.

21. The system of claim 20, wherein each respective conical surface has a respective apex and the cam and the plurality of cam followers are configured such that each of the plurality of apexes is coincident with each other and the plurality of apexes of the conical surfaces lie on the axis of rotation of the main shaft.

22. The system of claim 18, wherein at least two of the plurality of linkages are mechanically coupled with each other.

* * * * *